US012768061B1

(12) United States Patent
Dowell et al.

(10) Patent No.: US 12,768,061 B1
(45) Date of Patent: Oct. 20, 2026

(54) ELECTROCHEMICAL ANODE BARRIER CONFIGURATIONS

(71) Applicant: ElectraSteel, Inc., Boulder, CO (US)

(72) Inventors: Timothy James Dowell, Boulder, CO (US); Anders Hamburgen, Boulder, CO (US); Trevor M. Braun, Boulder, CO (US); Philip Wagner, Boulder, CO (US); Fridrik J. Diehl, Boulder, CO (US); Adolfredo Alvarez, Boulder, CO (US); Ai Quoc Pham, Boulder, CO (US)

(73) Assignee: ElectraSteel, Inc., Boulder, CO (US)

( * ) Notice: Subject to any disclaimer, the term of this patent is extended or adjusted under 35 U.S.C. 154(b) by 0 days.

(21) Appl. No.: 19/338,870

(22) Filed: Sep. 24, 2025

Related U.S. Application Data

(60) Provisional application No. 63/831,509, filed on Jun. 27, 2025.

(51) Int. Cl.
*C25C 7/02* (2006.01)
*C25B 1/04* (2021.01)
(Continued)

(52) U.S. Cl.
CPC ..... *C25C 7/02* (2013.01); *C25B 1/04* (2013.01); *C25C 1/06* (2013.01); *C25C 7/04* (2013.01)

(58) Field of Classification Search
None
See application file for complete search history.

(56) References Cited

U.S. PATENT DOCUMENTS 1,412,174 A 4/1922 Eustis et al.
1,432,543 A 10/1922 Eustis et al.
(Continued)

FOREIGN PATENT DOCUMENTS

CN 2871562 2/2007
CN 104947156 9/2015
(Continued)

OTHER PUBLICATIONS

Ahmed et al. (2003) "Responding to a Harsh Business Environment: A New Diaphragm for the Clor-Alkali Industry", The Electrochemical Society Interface, 34-39.
(Continued)

*Primary Examiner* — Harry D Wilkins, III
(74) *Attorney, Agent, or Firm* — Leydig, Voit & Mayer, LTD

(57) ABSTRACT

Provided herein is an iron electrowinning system comprising: an iron electrowinning cell comprising: a plating bath containing a catholyte having dissolved iron ions therein; and a cathode in contact with the catholyte and configured to electrodeposit iron metal thereon via electrochemical reduction of the dissolved iron ions; a removable anode cartridge assembly comprising: an anode configured to produce oxygen gas thereon via electrochemical water oxidation; an inner barrier defining an anolyte-region between the inner barrier and the anode, the anolyte-region containing an anolyte in contact with the anode; and an outer barrier defining a midlyte-region between the outer barrier and the inner barrier, the midlyte-region containing a midlyte, the midlyte being separated from the anolyte by the inner barrier and separated from the catholyte by the outer barrier; wherein the anode, inner barrier, and outer barrier are all suspended from a common hanger bar.

30 Claims, 7 Drawing Sheets

(51) Int. Cl.
*C25C 1/06* (2006.01)
*C25C 7/04* (2006.01)

(56) References Cited

U.S. PATENT DOCUMENTS

| | | | |
|---|---|---|---|
| 1,432,544 | A | 10/1922 | Eustis et al. |
| 1,451,333 | A | 4/1923 | Eustis et al. |
| 2,321,367 | A | 6/1943 | Diggin |
| 2,578,839 | A | 12/1951 | Renzoni |
| 2,810,686 | A | 10/1957 | Bodamer et al. |
| 3,072,545 | A | 1/1963 | Juda et al. |
| 3,347,761 | A | 10/1967 | Bicek |
| 3,394,068 | A | 7/1968 | Calmon et al. |
| 4,073,709 | A | 2/1978 | Pittie et al. |
| 4,075,069 | A | 2/1978 | Shinohara et al. |
| 4,087,339 | A | 5/1978 | Elliott et al. |
| 4,139,430 | A | 2/1979 | Parkinson et al. |
| 4,155,821 | A | 5/1979 | Grontoft |
| 4,159,232 | A | 6/1979 | Bacon et al. |
| 4,201,653 | A | 5/1980 | O'Neill et al. |
| 4,234,393 | A | 11/1980 | Hepworth et al. |
| 4,288,305 | A | 9/1981 | Garritsen et al. |
| 4,330,380 | A | 5/1982 | Parkinson et al. |
| 6,120,658 | A | 9/2000 | Dunn et al. |
| 6,860,983 | B2 | 3/2005 | Bellino et al. |
| 9,017,528 | B2 | 4/2015 | Papapanayiotou et al. |
| 9,206,517 | B2 | 12/2015 | Faita |
| 9,932,683 | B2 | 4/2018 | Barker et al. |
| 10,608,274 | B2 | 3/2020 | Mou et al. |
| 11,753,732 | B2 | 9/2023 | Pham et al. |
| 11,767,604 | B2 | 9/2023 | Pham et al. |
| 12,230,769 | B2 | 2/2025 | Whear et al. |
| 2010/0044243 | A1 | 2/2010 | Cardarelli |
| 2011/0089045 | A1 | 4/2011 | Cardarelli |
| 2014/0272458 | A1* | 9/2014 | Ruan ..... C22C 21/00 428/650 |
| 2014/0360865 | A1* | 12/2014 | Kimura ..... C25D 17/002 204/198 |
| 2015/0021195 | A1 | 1/2015 | Alkolkar et al. |
| 2021/0130977 | A1 | 5/2021 | Yamasaki |

FOREIGN PATENT DOCUMENTS

| | | | |
|---|---|---|---|
| CN | 209873135 | | 12/2019 |
| CN | 214782180 | | 11/2021 |
| CN | 217628659 | | 10/2022 |
| DE | 1155610 | | 10/1963 |
| DE | 1183698 | | 12/1964 |
| EP | 2268852 | | 12/2018 |
| GB | 940517 | | 10/1963 |
| GB | 992767 | | 5/1965 |
| JP | H05-39597 | | 2/1993 |
| JP | 2004360051 | A | 12/2004 |
| JP | 2006241568 | A | 9/2006 |
| JP | 2007077449 | A | 3/2007 |
| JP | 2007224400 | A | 9/2007 |
| JP | 2009167453 | A | 7/2009 |
| JP | 2011042820 | | 3/2011 |
| JP | 2012087394 | A | 5/2012 |
| JP | 2014088585 | A | 5/2014 |
| WO | WO 2010/000933 | | 1/2010 |
| WO | WO 2010/089452 | | 8/2010 |
| WO | WO 2013/079788 | | 6/2013 |
| WO | WO 2017/144912 | A1 | 8/2017 |
| WO | WO 2024/072741 | | 4/2024 |

OTHER PUBLICATIONS

Bhattarai et al. (2018) "Novel Approaches for Solving the Capacity Fade Problem during Operation of a Vanadium Redox Flow Battery," Batteries, 4, 48.

Boehnstedt (2006) "Separators and organics for lead-acid batteries", Journal of Power Sources 158, 1102-1105.

Choi (2021) "Techniques to Promote Oxidation Resistance in Polyethylene Battery Separators," Microporous LLC.

Crundwell (2011) "Electrowinning of Nickel from Purified Nickel Solutions", Extractive Mettalurgy of Nickel, Cobalt and Platinum-Group Metals, 26, 327-345 DOI: 10.1016/B978-0-08-096809-4.10026-7.

Filtaquip (Nov. 15, 2021) "Electrowinning Equipment Brochure," Filtaquip (Pty) Ltd. Mineral Processing Solutions, www.filtaquip.com.

Klang (1905) "BCI Separator Oxidation Testing," GNB Technologies, 163-166.

Mostad et al. (2008) "Electrowinning of Iron from Sulphate Solutions," Hydrometallurgy 90, 213-220.

Nieminen et al. (2011) "Development of Anode Bag Technology in Nickel Electrowinning", Outotec, ALTA-2011-NCC-Proceedings, 266-275.

Nieminen et al. (2011) "Development of Anode Bag Technology in Nickel Electrowinning," p. 266-275 of Alta 2011 Nickel/Cobalt/Copper Conference, May 23-25, 2011, Perth Australia.

Prabhu (2020) "Technology Competence and Innovative Solutions—Lead Acid Battery Separator", Daramic, LLC, 35 pp.

Wada et al. (2002) "Progress in polyethylene separators for lead-acid batteries," Journal of Power Sources 107, 201-210.

Ise et al. (1999) "Electroosmotic drag in polymer electrolyte membranes: an electrophoretic NMR study", Solid State Ionics125:213-223.

Rahbari et al. (2022) "Electro-osmotic Drag and Thermodynamic Properties of Water in Hydrated Nafion Membranes from Molecular Dynamics", J. Phys. Chem. C, 126:8121-8133.

Invitation to Pay Additional Fees and, Where Applicable, Protest Fees mailed Aug. 31, 2026 in PCT/US2026/034219.

* cited by examiner

ELECTROCHEMICAL ANODE BARRIER CONFIGURATIONS

CROSS-REFERENCE TO RELATED APPLICATIONS

This application claims the benefit of and priority to U.S. Provisional Patent Application Ser. No. 63/831,509, filed Jun. 27, 2025, which is incorporated herein by reference in its entirety for all purposes to the extent not inconsistent herewith.

GOVERNMENT FUNDING

This invention was made with government support under Award No. DE-AR0001902 awarded by Advanced Research Projects Agency-Energy (ARPA E), U.S. Department of Energy. The government has certain rights in the invention.

FIELD

This application relates generally to the field of electrochemical systems, and more particularly to electrowinning cell configurations and methods of their use.

BACKGROUND

Electrowinning is a method of recovering metals from a liquid solution containing one or more metals in the form of dissolved ionic species. Such solutions are variously referred to by terms such pregnant leach solution (PLS), metal-rich solution, leachate, electrolyte, or catholyte (among other terms). Materials containing the metal(s) of interest may be dissolved in an acid or base solution (often but not necessarily aqueous), which may then be treated as needed to achieve a desired composition or concentration of the metal(s) of interest and/or other constituents. The leachate may then be directed to an electrowinning cell or "bath" containing a collection of cathodes onto which the metal of interest is to be cathodically electroplated under an applied electric current. The bath also contains anodes for performing electrochemical oxidation reactions to balance charge with the cathodic electroplating. In some cases, the oxidation reaction desirably involves water-splitting and concomitant oxygen evolution.

Many metals, including copper, zinc, nickel, cobalt, and various precious metals have been commercially recovered from a wide range of feedstock materials by electrowinning from acidic leach solutions for many years. However, these example metals each have a single stable aqueous oxidation state (e.g., $Cu^{2+}$, $Zn^{2+}$, $Ni^{2+}$, $Co^{2+}$). In contrast to these metals, iron has two stable aqueous oxidation states: $Fe^{2+}$ ("ferrous") and $Fe^{3+}$ ("ferric"). Iron also has a relatively low overpotential for hydrogen evolution and is therefore susceptible to parasitic hydrogen evolution reactions during electroplating.

As a result, electroplating iron from acidic leach solutions against an anodic oxygen evolution reaction (OER) has significant challenges and inefficiencies. For example, any ferrous ions present in the anolyte (electrolyte in contact with an anode) will be readily oxidized to ferric ions at the anode, thereby both reducing the efficiency of the OER reaction and generating undesired ferric ions. Additionally, protons generated at the anode when splitting water will be reduced to hydrogen gas (HER) if they reach the cathode, thereby reducing electroplating efficiency. Excessive proton concentration (low pH) in the catholyte can also cause redissolution of electroplated metal at the cathode. While some ion exchange membranes may be useful in an iron-plating vs. OER configuration, Applicant has so far found commercially available anion exchange membranes (AEMs) to be inadequate for mitigating the above-described inefficiencies.

SUMMARY

Provided herein are electrochemical cells configured to mitigate the above problems while using relatively abundant and low-cost materials widely used in other industries. Various embodiments of electrochemical cells provided herein are referred to as "double-barrier anode" (or "DBA") cells, so-called because they include at least two fluid barriers between each anode/cathode pair.

The following patent applications are incorporated herein by reference in their entireties to the extent not inconsistent herewith: (1) International (PCT) Patent Application No. PCT/US2025/020236 ("2-Step Iron Conversion With Wüstite Intermediate"), filed Mar. 17, 2025, ("the Wüstite Application"); International Patent Publication WO/2024/072741 ("Stabilized lead dioxide anode and methods of using") ("the Stabilized Lead Application"); and International (PCT) Patent Application No. PCT/US2025/020228 ("Reductive Leach for Iron Extraction"), filed Mar. 17, 2025, (the "Reductive Leach Application"). Also incorporated herein is Applicant's U.S. Pat. No. 11,767,604 (the "'604 patent'"). In various embodiments, apparatus, systems, and methods described herein may be combined with apparatus, systems, and methods described in one or more of the Wüstite Application, the Stabilized Lead Application, the Reductive Leach Application, and the '604 patent.

Aspects and embodiments disclosed herein include an iron electrowinning system comprising: an iron electrowinning cell comprising: a plating bath containing a catholyte having dissolved iron ions therein; and a cathode in contact with the catholyte and configured to electrodeposit iron metal thereon via electrochemical reduction of the dissolved iron ions; a removable anode cartridge assembly comprising: an anode configured to produce oxygen gas thereon via electrochemical water oxidation; an inner barrier defining an anolyte-region between the inner barrier and the anode, the anolyte-region containing an anolyte in contact with the anode; and an outer barrier defining a midlyte-region between the outer barrier and the inner barrier, the midlyte-region containing a midlyte, the midlyte being separated from the anolyte by the inner barrier and separated from the catholyte by the outer barrier; wherein the anode, inner barrier, and outer barrier are all suspended from a common hanger bar.

Aspects and embodiments disclosed herein include a method of making electrolytic iron in an iron electrowinning system comprising: an iron electrowinning cell comprising: a plating bath containing a catholyte having dissolved iron ions therein; and a cathode in contact with the catholyte and configured to electrodeposit iron metal thereon via electrochemical reduction of the dissolved iron ions; a removable anode cartridge assembly comprising: an anode configured to produce oxygen gas thereon via electrochemical water oxidation; an inner barrier defining an anolyte-region between the inner barrier and the anode, the anolyte-region containing an anolyte in contact with the anode; and an outer barrier defining a midlyte-region between the outer barrier and the inner barrier, the midlyte-region containing a midlyte, the midlyte being separated from the anolyte by the inner barrier and separated from the catholyte by the outer barrier; wherein the anode, inner barrier, and outer barrier are all suspended from a common hanger bar; the method comprising: maintaining a pressure difference between the catholyte and the midlyte across the outer porous barrier sufficient to cause catholyte to flow through the outer porous barrier into the midlyte region; withdrawing a portion of midlyte from the midlyte region; electrodepositing iron metal on the cathode; and electrochemically oxidizing water and evolving oxygen at the anode.

STATEMENTS REGARDING CHEMICAL COMPOUNDS AND NOMENCLATURE

Figure 1:
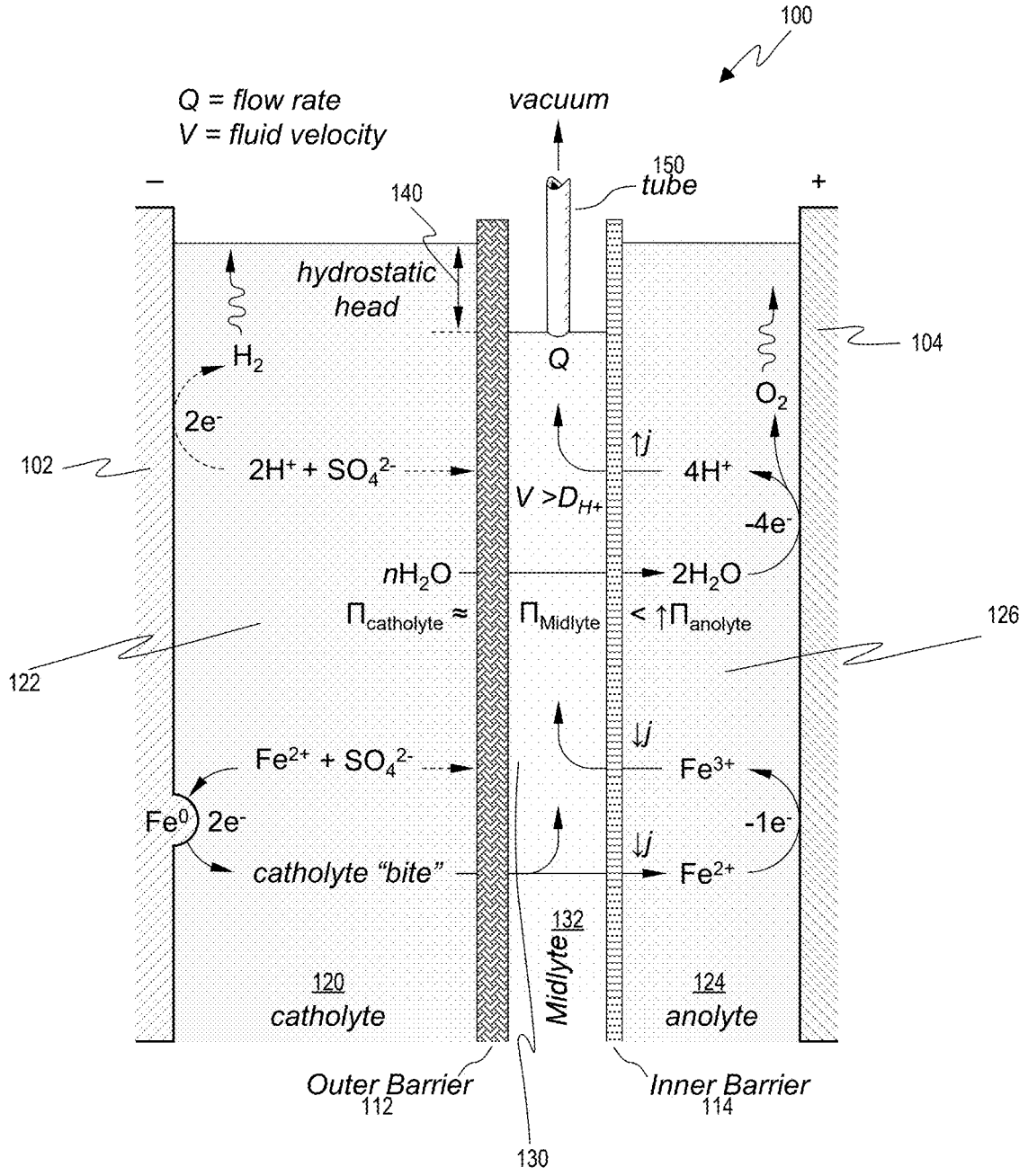
FIG. 1 is a schematic cross-sectional illustration of a portion of an electrochemical cell configured with a double barrier between anode and cathode.

In general, the terms and phrases used herein have their art-recognized meaning, which can be found by reference to standard texts, journal references and contexts known to those skilled in the art. The following definitions are provided to clarify their specific use in the context of this disclosure.

As used herein, the terms "barrier," "separator," "membrane," and "diaphragm" are used as conventionally understood in the field of electrochemistry and refer to a structure for dividing a volume of an electrochemical cell into discrete smaller volumes (also referred to as "compartments," "chambers," or "regions"). Barriers, separators, and diaphragms generally take the form of a material layer configured to regulate, mitigate, or restrict transport of some chemical species from one region to another. In an electrochemical cell containing solid or fluid reactants, a barrier, separator, or diaphragm generally separates two regions or volumes, such as one electrolyte (e.g., catholyte, midlyte, or anolyte) from another electrolyte (e.g., catholyte, midlyte, or anolyte), thereby regulating, mitigating, or restricting transport of molecules and/or ions from one electrolyte to the other.

While the terms "barrier," "separator," "membrane," and "diaphragm" may be conventionally used interchangeably, this disclosure makes some distinctions between the terms. As used herein, the term "barrier" is a broad categorical term that includes diaphragms, separators, ion exchange membranes, and any other structure that meets the above definition, regardless of material, shape, or other attributes. Non-limiting examples of barriers useful in the devices, systems, and methods herein include separators, membranes, porous materials (such as microporous and/or nanoporous materials), diaphragms, membranes, woven fabrics, nonwoven fabrics, ion exchange membranes, and combinations thereof (e.g., as separate layers, as heterogeneous structures, or otherwise combined).

As used herein, the terms "separator," "diaphragm" and "membrane" generally refer to narrower categories of barriers. Separators generally include electrically non-conductive (often polymeric) materials that are porous (including microporous and/or nanoporous), but have a lower permeability to water and ionic transport than "diaphragms". Separators are often (though not necessarily) extruded or cast sheets of polymer and/or ceramic materials with a defined or specified range of porosity.

Microporous and nanoporous separators generally have a very low water permeability while allowing some bi-directional transport of ionic species. In some cases, the term "membrane" may be synonymous with "separator," unless either term is further specified (e.g., "ion exchange membrane").

As used herein, the term "separator" generally refers to an electrically non-conductive layer that divides a volumetric space into two or more smaller spaces while permitting ionic transport in one or both directions through the separator. "Separators" may comprise polymeric, organic, and/or ceramic materials, including porous materials, microporous materials, nanoporous materials, and ion exchange materials, among other possible material constituents. In various aspects, a microporous and/or nanoporous barrier or separator is formed of or comprises inorganic material(s) (e.g., ceramics, silica), organic material(s) (e.g., polymer), or a combination thereof. In various aspects, a pore-forming component of a microporous and/or nanoporous barrier or separator comprises or consists essentially of inorganic material(s) such as silica, organic material(s) such as polymer(s), or a combination thereof.

As used herein, the term "diaphragm" generally refers to a category of barriers with larger porosity and/or greater water permeability. Diaphragms are often (though not necessarily) woven fabrics or non-woven fabrics (such as felted, meltblown, spunbonded, spunlaced, air-laid, and needle-punched fabrics). Diaphragms are generally electrically non-conductive, but have higher permeability to the flow of water or other liquids than separators and membranes. The degree of water permeability or resistance to water flow may be varied by changing material and/or processing characteristics such as weave density, fiber diameter, fiber count, weave pattern, or non-woven production method(s).

As used herein, the term "ion exchange polymer" or "ion exchange resin" refers to a solid polymer containing functional groups allowing for the exchange of ions with an adjacent medium (e.g., a solid or liquid electrolyte or solution). Ion exchange polymers (also known as "ionomers" or "ionex" materials) include "cation exchange polymers" functionalized to allow transfer of positively charged cations; and "anion exchange polymers" functionalized to allow transfer of negatively charged anions.

As used herein, the term "ion exchange membrane" refers to a non-porous, semi-permeable membrane that selectively permits the transport of specific ions while substantially excluding others, based on their charge and size. Ion exchange membranes may comprise fixed ionic groups—cationic or anionic or both—that facilitate the movement of counter-ions (ions of opposite charge) through the membrane matrix, while repelling co-ions (ions of like charge). Ion exchange membranes may be classified as cation exchange membranes (CEMs), which allow the passage of cations, or anion exchange membranes (AEMs), which allow the passage of anions. The non-porous nature of the membrane ensures that ion transport occurs via diffusion through the polymer matrix rather than through physical pores.

As used herein, a "cation exchange membrane" is used as conventionally understood in the field of electrochemistry and refers to an ion-selective membrane that permits or encourages transport (ionic conductivity) of cations (positively charged ions) while restricting or preventing transport of anions (negatively charged ions).

As used herein, the term "proton exchange membrane" is used as conventionally understood in the field of electrochemistry and refers to an ion-selective membrane that permits or encourages transport of protons (and optionally other cations) while restricting or preventing conductivity of anions.

As used herein, the term "anion exchange membrane" is used as conventionally understood in the field of electrochemistry and refers to an ion-selective membrane that permits or encourages transport of negatively charged anions while restricting or preventing conductivity of protons and other cations.

As used herein, the term "ion exchange resin" refers to a bulk material (in any physical form-factor) with properties of conducting one or more ionic species while preventing or restricting conductivity of one or more other ionic species.

As used herein, the terms "bag," "envelope," and similar terms refer to a shape or configuration of a flexible material formed with a continuous surface enclosing an interior volume at a bottom and all sides with an opening at a top of the volume. Bags may be formed from planar sheets formed into "bag" or "envelope" shapes corresponding to the size and shape of intended contents. Bags may be formed by folding and/or joining sections of material along seams secured by any available method, such as adhesives, sewed seams, welding, thermal bonding, solvent bonding, mechanical fasteners, or other materials or methods.

As used herein, for a first item to "surround" a second item or items, physical contact between the first and second items is not necessary. For example, a bag that at least partially surrounds a region/volume or item at least partially encompasses or encircles the region/volume or item, where the bag may be physically separated from the region/volume or item by one or more intervening substances or spaces. For example, a bag may at least partially surround an electrode with a liquid solution and/or other structures physically separating the bag from the electrode.

The term "pore", as used herein, refers to small and/or tortuous openings or paths extending from one face of a planar material to the opposite face of the material. The term "porous", as used herein, refers to a material or structure within which pores are present, organized and/or arranged in the material. In a porous material, the pores are volumes within the body of the material where there is no material (e.g. voids). Pores in a material are not intended to include the space occupied by atoms, ions and/or molecules of a material including monomers, oligomers and polymers, for example, of a barrier or separator. Porous materials and pores may be characterized by certain pore characteristics including, but not limited to, an average pore size, a maximum pore size, an O90 pore size, pore tortuosity, and others. A pore size generally refers to a cross sectional dimension such as diameter or cross-sectional width. Generally, as used herein, an average pore size refers to an empirically-derived numerical average of the diameter (or corresponding cross-sectional dimension) of the plurality of pores of a material or item.

The term "porosity" refers to a quantitative characteristic of a porous material or structure. In some embodiments, porosity is a measure of the void (i.e. "empty") volume, such as pores, in a material. Porosity may be expressed as the fraction of the volume of voids over the total volume, between 0 and 1, or as a percentage between 0% and 100%. As used herein, a porous material has characteristics allowing transport of protons across it via the Grotthuss mechanism.

As used herein, the term "O90 pore size" refers to a statistical measure of the pore size distribution within a porous material, such as a barrier, separator, or diaphragm. Specifically, the O90 value denotes the pore diameter at which 90% of the pores in the material are smaller than or equal to that diameter.

As used herein, a "microporous" material is characterized by an average pore size and/or an O90 pore size selected from the range of greater than 100 nm to less than or equal to 1 μm. As used herein, a "nanoporous" material is characterized by an average pore size and/or an O90 pore size selected from the range of 0.1 nm to less than 100 nm.

As used herein, "permeability" of a material refers to the capacity of a material, such as a porous material, to permit a substance of interest, such as aqueous dissolved ionic species, to pass through the material structure. Ion permeability encompasses the transport of ions driven by concentration gradients, electrochemical potential, pressure differentials, or other forces. In the context of porous materials, ion transport may occur through interconnected pores, channels, or voids within the material, and may be influenced by factors such as pore size distribution, surface charge, tortuosity, and the physicochemical interactions between the ions and the pore surfaces.

A barrier may be characterized in terms of relative ion permeabilities, such as permeability of aqueous protons through the barrier relative to permeability of aqueous metal ions through the same barrier under identical or equivalent conditions. For example, herein, barriers are characterized by a ratio of permeability of aqueous protons to permeability of aqueous metal cations (e.g., aqueous iron ions, including ferrous and ferric ions), where this ratio is also referred to as an "H:M permeability ratio". Likewise, a ratio of permeability of aqueous protons to permeability of aqueous iron cations (ferrous and ferric ions) is also referred to as an "H:Fe permeability ratio". The relative ion permeabilities, or H:M or H:Fe ratio, may be measured directly or estimated empirically. For example, the H:M ratio of an inner barrier, in systems and methods according to aspects herein, may be estimated via the ratio of proton concentration in the midlyte to ferric ion concentration in the midlyte after accounting for the respective baseline concentrations in the feed electrolyte. This is because both anodically-generated aqueous protons and anodically-generated aqueous ferric ions would need to pass through the inner barrier to be measured in the midlyte.

As used, herein, the term "permselectivity" is used as conventionally understood in the field of electrochemistry and refers to the preferential permeation of certain ionic species through a membrane or other barrier, influenced by factors such as ionic charge, individual ion mobility, and material properties of the barrier. Permselectivity of a barrier to a particular ion ("A") relative to a second ion of interest ("B") is defined as the ratio of the permeability of A through the barrier to the permeability of the other species of interest (B) through the barrier.

As used herein, the term "flux" refers to a movement of a substance (e.g., a fluid, a liquid, a solute within a solution, an ionic species, a group of ionic species) through a surface (e.g., a barrier, separator, membrane, diaphragm), and may be quantified as movement of the substance per unit area of the surface. Flux may include movement of the substance due to any motive force, such as diffusion, electromagnetic fields, forced or pumped flow, gravity-driven flow, or others. Flux may be expressed as a quantity (e.g., mass, volume, moles) of a substance per unit area per unit time (e.g., $mol/cm^2/second$).

As used herein, "shutdown temperature" of a porous material refers to a maximum operating temperature for the material in an acidic aqueous solution. At temperatures above the shutdown temperature, the material undergoes one or more failure mechanisms causing cessation of ion conductivity therethrough, dissolution of the material in the aqueous acidic solution, melting of the material in the aqueous acidic solution, and/or change in the pore size and porosity characteristics beyond an acceptable amount. As used herein, the material does not have pore size stability above its characteristic shutdown temperature.

As used herein, the term "pore size stability" refers to a material maintaining an average pore size, a maximum pore size, and/or an O90 pore size within 90% of a characteristic (or initial) average pore size, a characteristic maximum pore size, and/or a characteristic O90 pore size, respectively. For example, in some aspects herein, inner barrier and outer barrier materials have pore size stability for at least 1000 hours at a pH selected from the range of 2 to 3 and a liquid temperature selected from the range of 60° C. to 80° C.

As used herein, the term "removable" refers to an item or assembly of items that may be removed from and inserted/placed back into a vessel. In the case of an assembly of items, a removable assembly is monolithically removable, such that the assembly as a whole can be removed, as well as inserted/placed back, as one object.

As used herein, the term "spillover structure" refers to a liquid flow-control device for establishing a fixed liquid level in a liquid-containing vessel by allowing liquid exceeding the fixed level to flow over the spillover structure and out of the vessel due to gravity. Spillover structures may comprise any structural elements permitting or facilitating such flow, including weirs, dams, conduits, spouts, apertures, or combinations of these and/or other structures.

The term "lead anode" refers to an electrode configured to be polarized at oxidizing potentials to serv as an anode in an electrochemical system and containing lead and/or lead oxide exposed to an electrolyte (e.g., an anolyte). Some lead anodes comprise or are substantially formed of bulk metallic lead. Other lead anodes may comprise one or more layers of metallic lead and/or a lead oxide on a different material serving as mechanical and electrical support and/or substrate. As an oxidation reaction such as an oxygen evolution reaction (OER) proceeds, metallic lead will be oxidized to one or more lead oxides ($PbO_x$). Some lead anodes may also include some $PbSO_4$. Some lead anodes may comprise dopants and/or alloying elements to modify electrochemical or other properties of the anode. As used herein, the formula $PbO_x$ represents lead oxide inclusive of lead dioxide ($PbO_2$) and further inclusive of nonstoichiometric oxygen deficient variations of lead (di)oxide, including wherein x is greater than or equal to 1 and less than or equal to 2. As used herein, the formula $PbO_2$ is shorthand for lead dioxide and is intended to be inclusive of nonstoichiometric oxygen deficient variations thereof such that the compounds represented by the formula $PbO_2$ include those represented by $PbO_x$.

As used herein, the term "iron ore" is carries the conventional meaning as understood by those skilled in the art of mining and metals (including the arts of iron and steel manufacturing) and includes any naturally-occurring material (whether or not processed, refined, or beneficiated) that contains one or more forms of iron oxide.

"Iron ore," "iron feedstocks," and "iron source materials" generally include iron-containing materials with substantial quantities (such as but not limited to at least 10 wt. %, at least 20 wt. %, at least 25 wt. %, at least 30 wt. %, at least 35 wt. %, at least 40 wt. %, at least 45 wt. %, at least 50 wt. %, at least 55 wt. %, at least 60 wt. %, at least 65 wt. %, at least 70 wt. %, at least 75 wt. %, at least 80 wt. %, at least 85 wt. %, at least 90 wt. %, or at least 95 wt. %) of iron in any form, such as one or more iron oxides, one or more iron hydroxides, one or more iron oxyhydroxides, one or more iron carbonates, iron one or more sulfides, iron one or more silicates, one or more iron-based metals, one or more other iron metal or iron-containing materials that are products of ironmaking or steelmaking processes (e.g., slags, dusts, off-fall, scrap, pickling liquors), and/or one or more other iron-containing compounds, ores, rocks or minerals, including any mixtures thereof, in naturally-occurring states, man-made states, and/or beneficiated or purified states. Iron oxides include any forms such as goethite or limonite, magnetite, $Fe_4O_5$, $Fe_5O_6$, $Fe_5O_7$, $Fe_{25}O_{32}$, $Fe_{13}O_{19}$, wüstite, or combinations thereof.

As used herein, the terms "pure iron" and "high purity iron" are used in a relative sense to refer to a metallic iron material that is more pure than an iron source material, and contains an acceptably low quantity of one or more impurities. In some aspects, pure iron is at least 98 at. % Fe, at least 98.5 at. % Fe, at least 99.0 at. % Fe, at least 99.5 at % Fe, at least 99.9 at. % Fe, at least 99.95 at. % Fe, at least 99.99 at. % Fe, at least 99.995 at. % Fe, or at least 99.999 at. % Fe.

As used herein, the term "oxide" is intended to be inclusive of hydroxides and hydrated oxides. Some embodiments of devices, processes and systems described herein may be particularly useful for iron feedstocks comprising, consisting of, or consisting essentially of one or more iron ores (or blends of iron ores) including hematite, goethite, magnetite, limonite, siderite ($FeCO_3$), ankerite, turgite, bauxite, pyrite, fayalite, or any combination thereof. Optionally, an iron source material or iron feedstock may further comprise an iron metal material, such as, but not limited to, iron dust (e.g., fine particulate produced as a byproduct of ironmaking or steelmaking processes in blast furnaces, oxygen furnaces, electric arc furnaces, etc.), steelmaking slag, iron powder, scrap steel, mill scale (as the term is known in the art), and/or scrap iron such as scrap wrought or cast iron. Feedstocks may comprise various other non-iron materials, which are generally referred to herein as "impurities" or "non-iron impurities."

As used herein, the term "impurity" refers to an element or compound other than a desired final product material (e.g., iron or other desired product material(s)). In various embodiments, depending on the intended end-use of a product material, a given element or compound may or may not be considered an "impurity." In some cases, one or more elements or compounds that may be impurities to one process or sub-process may be isolated or purified, collected, and sold as a secondary product material (also referred to as "co-products" or "by-products").

The term "iron-based metal" refers to a metal or metallic material, such as an alloy, characterized by a composition having greater than 50 at. % Fe. Optionally, in aspects herein, an iron-based metal is a metal or metallic material, such as an alloy, characterized by a composition having at least 60 at. % Fe, optionally at least 70 at. % Fe, optionally at least 80 at. %, optionally at least 90 at. % Fe, optionally at least 95 at. % Fe, optionally at least 97 at. % Fe, optionally at least 98 at. % Fe, optionally at least 98.5 at. % Fe, optionally at least 99.0 at. % Fe, optionally at least 99.5 at. % Fe, optionally at least 99.9 at. % Fe, optionally at least 99.95 at. % Fe, optionally at least 99.99 at. % Fe. Iron-based metals include, but are not limited to, metallic iron or iron metal, steel materials, silicon steel, silicon iron, electrical steel, electrical iron, cast iron, gray iron, white iron, ductile iron, malleable iron, wrought iron, any iron-carbon alloy characterized by greater than 50 at. % Fe (optionally at least 60 at. % Fe, optionally at least 70 at. % Fe, optionally at least 80 at. %, optionally at least 90 at. % Fe, optionally at least 95 at. % Fe), and any combinations thereof.

As used herein, the terms "steel" and "steel material" are inclusive of any material known in the art as "steel", such as, but not limited to, stainless steels, carbon steels, tool steels, crucible steels, spring steels, alloy steels, maraging steels, high-speed steels, weathering steels, and any variations and grades thereof.

As used herein, the term "oxidation state" carries its normal meaning in the context of chemistry and refers to a number assigned to an element which represents the number of electrons lost (if the number is positive) or gained (if negative) by an atom of that element in a chemical compound or aqueous ionic state. The oxidation number is generally denoted as a superscript such as the "2+" in $Fe^{2+}$ (ferrous iron), but may also be denoted by parenthetical roman numerals such as Fe(II).

The terms "electroplating", "electroforming", and "electrowinning" are used herein interchangeably to refer to electrochemical recovery of one or more metals from a liquid solution containing the one or more metals in the form of dissolved ionic species. The term "iron electroplating" (or "iron plating" as used synonymously herein) refers to a process by which dissolved iron is electrochemically reduced to metallic iron on a cathodic surface. Equivalent terms "iron electrodeposition," "iron electroforming," and "iron electrowinning" are also used herein synonymously with "iron electroplating." The shape or form-factor of the electroplated iron need not be a "plate" by any definition of that term. For example, electroplated iron may take any shape or form and may be deposited on any suitable cathodic surface as described in various embodiments herein. Examples of possible physical forms of "electroplated" (or equivalently, "plated") iron include chips, flakes, coins, rounds, crowns, powder, strips, or other shapes. Further, the shape or form of the electroplated iron may further be influenced by the shape or form of the cathode, which may be in the form of plate(s), cylinder(s), cast or machined part(s), and/or any other form useful for an application.

In some embodiments, a cathodic surface material may be selected for a degree to which deposited iron adheres to the cathodic surface. For example, if a desired electroplated product is a powder, a cathodic surface with a low iron adhesion may be desired. Examples of materials with high and low iron adhesion properties are described herein, and additional examples will be clear to those skilled in the art. In various embodiments, some regions of a cathode may be masked prior to electroplating for producing electroplated material in a desired shape or form-factor.

As used herein, electrochemically generated ions, such as electrochemically generated protons and electrochemically generated iron ions (e.g., $Fe^{2+}$, $Fe^{3+}$), refer to ions that are generated or produced in an electrochemical reaction. For example, electrochemical oxidation of water at an anode may electrochemically generate protons and electrochemically generate oxygen. For example, aqueous ferrous ($Fe^{2+}$) ions in an anolyte may be electrochemically oxidized at an anode to aqueous ferric ($Fe^{3+}$) ions. As used herein, the term "anodically generated" ions refers to ions generated by electrochemically oxidation at an anode. As used herein, the term "cathodically generated" ions refers to ions generated by electrochemically reduction at a cathode.

As used herein, aqueous protons and electrochemically generated protons are intended to be inclusive of aqueous protons and aqueous hydronium ions.

As used herein, unless otherwise specified, the terms "ferric iron solution" or "ferric solution" refers to an aqueous solution that contains dissolved iron that is at least predominantly (i.e., between 50 mol. % and 100 mol. %) in the $Fe^{3+}$ (i.e., "ferric") ionic state with the balance of dissolved iron being in the "ferrous" $Fe^{2+}$ state. Similarly the term "ferric ion" refers to one or more ions in the ferric ($Fe^{3+}$) state. Either "ferric solutions" or "ferrous solutions" may also contain other dissolved ions or colloidal or particulate materials, including non-iron impurities.

The term "dissolved" in reference to ions, such as dissolved ferric ions or dissolved ferrous ions, refers to ions dissolved and thereby solvated by a solvent such as water or an aqueous solution. As used herein, the term "aqueous ions", such as aqueous ferric ions or aqueous ferrous ions, refers to ions dissolved in water. The term "non-dissolved" refers to a solid undissolved non-solvated species. The term "non-dissolved ferric" and "solid ferric" refer to any one or more solid compositions or materials in which ferric ($Fe^{3+}$ or Fe(III)) exists in a non-dissolved solid, such as, for example, ferric in solid particles or pieces of hematite. As an illustrative example, reduction of solid hematite to solid magnetite comprises the reduction of non-dissolved (solid) ferric to non-dissolved (solid) ferrous. The term "non-dissolved ferrous" and "solid ferrous" refer to any one or more solid compositions or materials in which ferrous ($Fe^{2+}$ or Fe(II)) exists in a non-dissolved solid, such as, for example, ferrous in solid particles or pieces of magnetite or wüstite. Likewise, the term "solid ions", such as "solid iron ions", refers to ions bound in a solid and undissolved composition.

As used herein, the term "material" is inclusive of pure materials and mixtures of a plurality of different materials or species.

As used herein, the terms "aqueous iron ion" and "aqueous dissolved iron ion" are used interchangeably. It will be understood that aqueous ions, such as aqueous iron ions, are ions that are dissolved in an aqueous solution. The term "aqueous iron ions" refers to dissolved iron ions of any and all possible oxidation states in the respective or referenced solution under its conditions, including but not necessarily limited to, dissolved ferric ($Fe^{3+}$) and ferrous ($Fe^{2+}$) ions. The term "aqueous ferrous ions" refers to aqueous dissolved ferrous ($Fe^{2+}$) ions in a solution. The term "aqueous ferric ions" refers to aqueous dissolved ferric ($Fe^{3+}$) ions in a solution.

As used herein, when referring to a compound or ions being aqueous, the term "aqueous" refers to said compound or ions, respectively, being dissolved or solvated by water. An "aqueous solution" refers to a solution that comprises water as solvent and one or more solute species dispersed, dissolved, or otherwise solvated by the water. Optionally, but not necessarily, an aqueous solution or an aqueous solvent includes 20 vol. % or less, optionally 15 vol. % or less, optionally 10 vol. % or less, preferably 5 vol. % or less, of a non-water liquid.

As used herein, an "iron-rich" aqueous solution is an aqueous solution having ions dissolved therein wherein aqueous iron ions (including ferric and ferrous ions) are more than 50 mol. % (optionally more than 60 mol. %, optionally more than 70 mol. %, optionally more than 80 mol. %, optionally more than 90 mol. %, optionally more than 95 mol. %, optionally more than 98 mol. %, optionally more than 99 mol. %) of all aqueous cation species in said solution.

As used herein, a "ferrous-rich" aqueous solution, such as a ferrous-rich aqueous leachate and a treated ferrous-rich aqueous solution, is an aqueous solution having iron ions dissolved therein wherein the concentration ratio of dissolved ferrous ions to all dissolved iron ions in said solution is greater than 0.50 (optionally greater than 0.60, optionally greater than 0.70, optionally greater than 0.80, optionally greater than 0.90, optionally greater than 0.95, optionally greater than 0.98, optionally greater than 0.99, optionally greater than 0.995, optionally greater than 0.999). In some aspects herein, the ferrous-rich leachate is characterized by a ratio of concentrations of $Fe^{3+}$ ions to $Fe^{2+}$ ions being less than or equal to approximately 0.01, optionally less than or equal to approximately 0.009, optionally less than or equal to approximately 0.0075, optionally less than or equal to approximately 0.005, optionally less than or equal to approximately 0.0025, optionally less than or equal to approximately 0.001, or optionally the ratio can be greater than or equal to 0.0075, 0.005, 0.0025, or 0.001 and such values can be combined in any manner to form a range, such as 0.001 to 0.01.

As used herein, a "ferric-rich" aqueous solution is an aqueous solution having iron ions dissolved therein wherein the concentration ratio of dissolved ferric ions to all dissolved iron ions in said solution is greater than 0.50 (optionally greater than 0.60, optionally greater than 0.70, optionally greater than 0.80, optionally greater than 0.90, optionally greater than 0.95, optionally greater than 0.98, optionally greater than 0.99).

The term "total iron ion concentration" refers to the concentration of all aqueous iron ions, including but not limited to ferrous and ferric ions, in a referenced aqueous solution. The term "ferric ion concentration" refers to the concentration of all aqueous ferric ions in a referenced aqueous solution. The term "ferrous ion concentration" refers to the concentration of all aqueous ferrous ions in a referenced aqueous solution.

As used herein, the terms "steady state" and "steady-state" generally refer to a condition or a set of conditions characterizing a process, a method step, a reaction or reactions, a solution, a (sub)system, etc., that are true longer than they are not true during operation or performance of the process, method step, reaction or reactions, solution, (sub) system, etc. For example, an electrolyte during operation of an electrochemical cell (such as an iron electrowinning cell) may be characterized by a steady state parameter, such as a steady state pH or a steady state concentration of specified dissolved ions, wherein the steady state parameter is true during at least 50%, optionally at least 60%, optionally at least 70%, optionally at least 80%, optionally at least 90%, optionally at least 95% of a time during which the cell is operating. For example, a steady state condition is generally exclusive of conditions characterizing the transient start-up and shut-down phases of a process.

As used herein, the term "ionic conductivity" is used as conventionally understood in the field of electrochemistry and refers to a material property of permitting or encouraging transport of one or more ionic species through the material, wherein "material" is inclusive of solid materials and liquid materials.

As used herein, the term "electronic conductivity" is used synonymously with "electric conductivity" and "electrical conductivity" (including all equivalent adverb forms) and refers to a material property of conducting electrons through the material, wherein "material" is inclusive of solid and liquid materials.

As used herein, the term "electrolyte" refers to a liquid (including aqueous liquids, ionic liquids, and other non-aqueous liquids) containing free ions capable of diffusing through the liquid. In some cases, electrolytes may comprise gaseous components, including dissolved gasses, gas bubbles in liquid, and gas/liquid mixtures.

As used herein, the term "catholyte" is used as conventionally understood in the field of electrochemistry and refers to an electrolyte in contact with an electrochemical cathode.

As used herein, the term "anolyte" is used as conventionally understood in the field of electrochemistry and refers to an electrolyte in contact with an electrochemical anode.

As used herein, the term "active area" is used as conventionally understood in the field of electrochemistry and refers to an area of an electrochemical cell in which electrochemical reactions occur. The "active area" of an electrochemical cell may correspond to an area of an anode, an area of a cathode, an area of a separator, or combinations of these. An "active area" of an electrode (anode or cathode) may be less than a total area of the electrode if portions of the electrode are blocked by ionically non-conductive materials that prevent ions or other electrochemical reactants from reaching those portions of the electrode surface.

As used herein, the terms "anode chamber" and "cathode chamber" are used as conventionally understood in the field of electrochemistry and refer to regions of an electrochemical cell containing "anolytes" and "catholytes," respectively. Anode and/or cathode "chambers" may be fluidically sealed from other regions of a cell, and may be configured to allow electrolyte to flow-through the chamber or to statically contain the electrolyte (or both, potentially at different times). Other terms such as "volume," "reaction space," or "compartment" may be used in place of the word "chamber."

As used herein, the terms "metal rich solution," "metal rich electrolyte" "leachate," "lixiviant" or other related terms may refer to a liquid suitable for use as a catholyte in a metal electrowinning cell.

Examples are described with reference to iron electrowinning, but cells having features, structures, or advantages described herein may be configured for electrowinning, electroplating, or electrodeposition of other metals or alloys, such as Ni, Cu, Co, Sn, Mn, Al, Ti, Au, Ag, Zn, Cd, platinum group metals, rare earth metals, alkali metals, or alloys of these. Additionally, configurations and methods described herein may also be embodied in other electrochemical systems such as flow batteries, electro-refinement cells, water electrolysis cells (e.g., for the production of hydrogen and/or oxygen), or electrochemical synthesis systems for production of chemicals such as ammonia or others.

The term "predominantly" is used herein to refer to a property, condition, or value being greater than 50%. In specific instances, the term "predominantly" may indicate a property, condition, or value being greater than 60%, greater than 70%, greater than 80%, greater than 90%, greater than 95%, greater than 98%, greater than 99%, greater than 99.5%. For example, a material mixture characterized as "predominantly wüstite" is more than 50 mol. % wüstite, or in other instances at least 60 mol. % wüstite, at least 70 mol. % wüstite, at least 80 mol. % wüstite, at least 90 mol. % wüstite, at least 95 mol. % wüstite, at least 98 mol. % wüstite, at least 99 mol. % wüstite, at least 99.5 mol. % wüstite, with the balance being other compositions, such as but not limited to hematite, magnetite, iron metal, and/or impurities.

The terms "substantially" and "approximately" are used interchangeably and refer to a property, condition, or value that is equivalent to or is within a reasonable variance from a stated property, condition, or value. For example, a property, condition, or value described as "substantially" or "approximately" X (X being a number for purpose of this paragraph) may include properties, conditions, or values that are within 20%, within 10%, within 5%, within 1%, or within 0.1% of said X. Examples of such uses include phrases such as "substantially equal", "substantially equivalent", "substantially unchanged", "approximately", and "approximately equal to."

As used herein, the term "wt. %" or "wt %" refers to a weight percent, or a mass fraction represented as a percentage by mass. The term "at. %" or "at %" refers to an atomic percent, or an atomic ratio represented as a percentage of a type of atom with respect to total atoms in a given matter, such as a molecule, compound, material, nanoparticle, polymer, dispersion, etc. The term "mol. %" refers to molar percent or percent by moles. The term "vol. %" refers to volume percent.

As used herein, the term "and/or" is used herein, in the description and in the claims, to refer to a single element alone or any combination of elements from the list in which the term and/or appears. In other words, a listing of two or more elements having the term "and/or" is intended to cover embodiments having any of the individual elements alone or having any combination of the listed elements. For example, the phrase "element A and/or element B" is intended to cover embodiments having element A alone, having element B alone, or having both elements A and B taken together. For example, the phrase "element A, element B, and/or element C" is intended to cover embodiments having element A alone, having element B alone, having element C alone, having elements A and B taken together, having elements A and C taken together, having elements B and C taken together, or having elements A, B, and C taken together.

As used herein, the term "±" refers to an inclusive range of values, such that "X±Y," wherein each of X and Y is independently a number, refers to an inclusive range of values selected from the range of X−Y to X+Y. In the cases of "X±Y" wherein Y is a percentage (e.g., 1.0±20%), the inclusive range of values is selected from the range of X−Z to X+Z, wherein Z is equal to X·(Y/100). For example, 1.0±20% refers to the inclusive range of values selected from the range of 0.8 to 1.2.

While some figures illustrate a partial active-surface of a single anode and a partial active-surface of a single cathode, in many commercial embodiments, DBA cells may be configured with many anodes and cathodes (e.g., tens, hundreds, or thousands of each) in a single bath. If the purpose of such cells is for production of an electrodeposited metal, the cells may be arranged with each cathode positioned between a pair of anodes, such that a cell (or bath) with "n" cathodes may have "n+1" anodes. Alternatively, if the purpose of such cells is to produce an anodic product, the cells (or baths) may be arranged with each anode positioned between a pair of cathodes, such that a cell with "n" anodes may have "n+1" cathodes.

DETAILED DESCRIPTION

In the following description, numerous specific details of devices, device components and methods are set forth to provide a thorough explanation of the precise nature of the various inventions described herein. It will be apparent, however, to those of skill in the art that the various inventions can be practiced without these specific details. Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of devices, systems, and methods may nonetheless be operative and useful.

While several examples are provided herein with reference to sulfuric acid ($H_2SO_4$) as the acid used in lixiviant and electrowinning solutions, those skilled in the art will recognize that the systems and methods described herein may be used with other instead of or in combination with sulfuric acid. For example, other acids can include but are not limited to hydrochloric acid, sulfurous acid, sodium bisulfate, potassium bisulfate, ammonium bisulfate, magnesium bisulfate (or magnesium hydrogen sulfate), phosphoric acid, nitric acid, acetic acid, oxalic acid, citric acid, boric acid, perboric acid, carbonic acid, methanesulfonic acid, or any mixture or combination of these or other acids.

FIG. 1 schematically illustrates components of a DBA cell 100 shown in a cross-sectional view. FIG. 1 shows a section of a cathode 102 (e.g., configured for metal electrowinning, electroplating, or electrodeposition) and a section of an anode 104 (e.g., configured for OER) separated from one another by two barriers: a first outer barrier 112 (also referred to as an "outer bag" or "outer separator") and a second inner barrier 114 (also referred to an "inner bag" or "inner separator"). A catholyte 120 occupies a catholyte region 122 between the cathode 104 and the outer barrier 112 and an anolyte 124 occupies an anolyte region 126 between the inner barrier 114 and the anode 104. The outer barrier 112 and inner barrier 114 are spaced from one another to form a volumetric "midlyte" region 130 between them containing a middle electrolyte 132, referred to herein as the "midlyte."

The cathode electrode 102 may comprise any material or configuration as needed for a desired application. In some embodiments, cathodes configured for electrodeposition of a metal may comprise a conductive material such as steel, iron, aluminum, graphite, and/or other materials or combinations of materials in the form of a plate, sheet, belt cylinder or other shape.

The anode electrode 104 may comprise any electrode suitable for supporting the anodic reaction(s) of interest. In embodiments in which an oxygen evolution reaction (OER) is desired, the anode may comprise lead, lead dioxide, lead dioxide alloys (e.g., lead alloys comprising one or more alloying elements such as silver, tin, calcium, cobalt, cadmium, antimony, copper, strontium, barium, titanium, or other metal or nonmetal elements or compounds), dimensionally stable anode (DSA) anodes such as those incorporating mixtures of precious metal oxides (e.g. electrodes comprising one or more oxides, metals, compounds, or solid solutions comprising elements such as iridium, ruthenium, rubidium, titanium, palladium, gold, silver, molybdenum, manganese, cobalt, etc.), or any other suitable catalytic materials or surfaces. In various aspects herein, the anode is a lead anode. In various embodiments, OER catalysts comprising any of the foregoing materials may be coated onto a support structure such as a sheet (solid or perforated), mesh, or expanded sheet of an electrically conductive material such as titanium, carbon, graphite, or others.

In some embodiments, the role of the outer barrier 112 includes establishing a region of electrolyte flow directed away from the adjacent cathode(s) so as to substantially decrease or prevent flow or diffusion of undesired ionic species into the region(s) adjacent the cathode. Undesired ionic species may include acid (in the form of hydronium ions or $H^+$ ions generally), including but not limited to anodically-produced acid (in the form of hydronium ions or $H^+$ ions generally) and/or acid provided to the catholyte or plating bath as a feed, ferric ions, including but not limited to anodically-produced ferric ions ($Fe^{3+}$), and/or other dissolved species originating at or near the anode that may be deleterious to desired cathodic reactions or to the cathode itself.

Suitable outer barrier materials may comprise conventional "diaphragm" materials configured to allow flow at a desired rate through their thickness. Suitable outer barrier materials may comprise porous or microporous membranes, ion exchange membranes, or impermeable structures configured to selectively permit flow in one direction while limiting diffusion in the opposite direction (e.g., conduits, spillover structures, or others).

One role of the inner barrier 114 is to slow diffusion of dissolved metal ions (e.g., $Fe^{2+}$ and/or $Fe^{3+}$) through the inner barrier 114 between the anolyte region 126 and the midlyte region 130 while, in at least some embodiments, permitting transport of protons ($H^+$) and of water which may be driven through the inner barrier by osmotic pressure from the midlyte 132 to the anolyte. The inner barrier may also be selected to have a lower permeability to water, acid, and metal cations compared to the outer barrier 112. In some particular embodiments, the inner barrier may be selected to be substantially impermeable to liquid flow and/or to impart proton permselectivity for allowing greater transmission of protons compared to metal cations. In various aspects and embodiments, an inner barrier has a high permselectivity for aqueous protons compared to aqueous metal cations. In various aspects and embodiments, an inner barrier is characterized by an H:M permeability ratio that is at least approximately 5 (i.e., 5:1), at least approximately 10, at least approximately 20, at least approximately 100, at least approximately 200, at least approximately 500, at least approximately 1000, or greater.

In various aspects and embodiments, the outer barrier may be characterized by an H:M permeability ratio that is approximately 1 (i.e., 1:1). Therefore, in various aspects and embodiments, an inner barrier is characterized by an H:M permeability ratio that is greater than the same of the outer barrier by a factor of at least approximately 5, at least approximately 10, at least approximately 20, at least approximately 100, at least approximately 200, at least approximately 500, at least approximately 1000, or greater.

An inner barrier may be less permeable to bulk liquid (e.g., a solvent, such as water in an aqueous system) than the outer barrier. In various aspects and embodiments, the outer barrier is characterized by a bulk liquid permeability that is greater than the bulk liquid permeability of the inner barrier (s) by a factor of at least approximately 5, at least approximately 10, at least approximately 20, at least approximately 100, at least approximately 200, at least approximately 500, at least approximately 1000, or greater.

In some embodiments, microporous or nanoporous separator materials may be suitable inner barrier materials due to their low cost and ability to meet the above functions and specifications. In other embodiments, the inner barrier 114 may comprise a diaphragm with a lower permeability to water, acid, and metal cations compared to the outer barrier 112.

In embodiments in which a double-barrier anode cell is configured for electrowinning of a metal, the catholyte region 120 may also be referred to as a "plating bath" in which multiple anodes and cathodes are suspended by hanger bars (e.g., as described below with reference to FIG. 7). The purpose of the catholyte region 122 (or plating bath) is to contain a metal-rich catholyte introduced via a bath inlet (not shown), allowing the catholyte 120 to contact and flow over surfaces of the cathodes 102. In some embodiments, a bath outlet (not shown) may be configured to maintain a target electrolyte liquid level in the bath in a conventional manner (e.g., by a spillover outlet, a suction pump, or other level-setting outlet).

The midlyte region 130 contains an electrolyte with an elevated concentration of protons (i.e., a lower pH) as compared with the catholyte region 122 due to migration of protons from the anolyte region 126. The midlyte electrolyte 132 may have a liquid level maintained at a lower hydrostatic head than the catholyte 120 (e.g., by a vacuum pump withdrawing midlyte 132 via a tube 150 or by spillover structures or other conventional methods).

The liquid level difference between the midlyte and the anolyte is influenced by, and may be manipulated by, one or more of a variety of parameters or conditions including, but not limited to, catholyte feed rate, flux of fluid through the outer barrier (which is a function of parameters such as outer barrier porosity, outer barrier O90 pore size, outer barrier pore open area, and/or others), midlyte withdrawing rate, and flux of fluid through the inner barrier (which is a function of parameters such as inner barrier porosity, inner barrier O90 pore size, inner barrier pore open area, ion concentration in midlyte and anolyte, osmotic pressure between the midlyte and anolyte, presence or absence of a hydraulic shunt between the midlyte and anolyte, and/or others).

In some embodiments, the midlyte region 130 may contain structures configured to maintain a desired volume in the region 130 (e.g., to prevent flexion of the outer barrier 112 and/or inner barrier 114 layers). In some embodiments, the midlyte region 130 may contain structures configured to direct flow of the midlyte electrolyte 132 within the midlyte volume 130.

In some embodiments, the anolyte region 126 may similarly contain structures configured to maintain a desired volume to provide adequate water for splitting in the oxygen evolution reaction (OER). For example, the anolyte region 126 may contain structural elements to maintain a desired spacing between the inner barrier relative and the anode. In some embodiments, the anolyte region 126 may contain structures configured to facilitate upward movement of oxygen gas bubbles produced in the oxygen evolution reaction and/or to facilitate removal of produced oxygen from an upper headspace portion of the anolyte region 126.

In operation, fresh solution (e.g., catholyte comprising a solvent and solute) is provided to the catholyte region 122 of the cell 100. The electrolyte fluid then flows from the catholyte region 122 through the outer barrier 112, and into the midlyte region 130. This flow path through the outer barrier 112 can be facilitated by maintaining a pressure difference (e.g., in the form of a hydrostatic head as shown at 140 or by pumps or other pressure-inducing mechanisms) driving fluid from the catholyte region 122 through the outer barrier 112 into the midlyte region 130. Liquid may also be exchanged between the midlyte region 130 and the anolyte region 126 via the inner barrier. In some embodiments, it is advantageous if the flow of fluid from the midlyte region 130 to the anolyte region 126 is dominated by osmosis. Examples of osmotic flow are described below.

In the example of FIG. 1, a "bite" (i.e., a discrete decrease in metal-ion concentration relative to the supplied catholyte feed) is taken out of the catholyte as metal (e.g., iron in this example) that is plated onto the cathode 102. In some embodiments, the catholyte 120 may be maintained at a relatively high pH (e.g., above 2 to 7) in order to achieve high plating efficiency by minimizing availability of aqueous protons for parasitic hydrogen evolution reactions at the cathode 102. However, if the catholyte pH is too high, any $Fe^{3+}$ ions in the catholyte will tend to precipitate as ferric hydroxide, decreasing plated iron quality and blocking catholyte flow. Therefore, depending on a target plating efficiency and an expected ferric concentration, catholyte in the plating bath may be at a pH of between about 2 and about 5.

This high-pH catholyte 120 containing metal ions is then driven through the outer barrier 112 into the midlyte region 130 where it becomes acidified, or further acidified, due to protons migrating into the midlyte 132 from the anolyte 124 (generated by the oxygen evolution reaction (OER) at the anode 104). The anodically-produced protons cross the inner barrier 114 into the midlyte 132 by diffusion (such as but not limited to Grotthuss mechanism) due to concentration and electrochemical gradients. The inner barrier 114 also slows the flux of metal (e.g., ferrous) cations in the midlyte 132 from crossing into the anolyte 124 and reaching anode 104 due to desired material properties as described herein. Suppressing the concentration of oxidizable metal ions in the anolyte 124 has the effect of increasing the selectivity of OER reactions at the anode 104 relative to oxidation of the metal cations (e.g., $Fe^{2+}$ to $Fe^{3+}$). Likewise, any metal cations that do become oxidized at the anode must again cross the inner barrier 114 to reach the midlyte 130. The inner barrier being configured to slow the flux of oxidized metal ions into the midlyte beneficially limits the concentration of oxidized metal ions in the midlyte solution 130. Minimizing concentration of oxidized metal ions in the midlyte solution 130 allows for an overall improvement to the system efficiency by decreasing energy required for re-reduction of oxidized metal ions to a more reduced state (e.g., $Fe^{3+}$ to $Fe^{2+}$), among other technical and economic benefits.

The double-barrier anode configuration described herein also benefits from the fact that aqueous $H^+$ diffusion is generally more than an order of magnitude greater than diffusion of aqueous metal cations (e.g., $Fe^{2+}$ and/or $Fe^{3+}$) under identical conditions. This difference in diffusion rates means that $H^+$ will diffuse through the inner barrier 114 from the anolyte 124 to the midlyte 132 at a higher rate or flux compared to metal cations diffusing in either direction through the inner barrier 114, ultimately resulting in a low concentration of oxidized metal cations in the midlyte 132. For example, in various embodiments the concentration of oxidized metal cations (e.g., $Fe^{3+}$) in the midlyte 132 may be established and maintained at less than approximately 1 M, less than 0.5 M, less than 0.4 M, less than 0.3 M, less than 0.2 M, less than 0.15 M, less than 0.1 M, less than 0.05 M, or less than 0.01 M by selecting inner and outer barrier materials with suitable water permeabilities and ionic permeabilities and/or by adjusting the rate of flow of midlyte withdrawn from the midlyte region.

The anolyte pH is dependent on factors including, but not limited to, ionic conductivity of the inner barrier, cell current density, and midlyte withdrawal flow rate. Generally, at steady state operation, the anolyte pH will be less than or equal to the midlyte pH. For example, in some aspects, the anolyte pH at steady state may be in the range of approximately −0.7 to approximately 1.

In some embodiments, the anode is a lead electrode and the anolyte comprises a concentration of iron ions. A concentration of iron ions in the anolyte may beneficially stabilize a lead-containing anode electrode as described in the Stabilized Lead Application referenced above. In some embodiments, parameters such as inner barrier material, flow rates, and/or hydrostatic head (or other pressure differences) between regions may be selected to maintain a stabilizing concentration of iron ions in the anolyte while minimizing the concentration of $Fe^{3+}$ in the midlyte. For example, in some aspects, the concentration of aqueous iron ions in the anolyte is at least approximately 0.001 M, at least approximately 0.005 M, at least approximately 0.01 M, or selected from the range of approximately 0.001 M and approximately 1.5 M.

The systems and methods disclosed herein are compatible with a wide range of electrolyte temperatures, such as but not limited to approximately 20° C. to approximately 100° C. In various aspects and embodiments, the catholyte, midlyte, and/or anolyte liquid temperature, during operation of the cell, is selected from the range of approximately 50° C. to approximately 90° C. or approximately 55° C. to approximately 85° C.

In various embodiments, parameters such as outer barrier material, inner barrier material, flow rates (through the outer barrier or midlyte removal rate), and/or hydrostatic head (or other pressure differences) between regions may also be selected to establish and/or maintain a desired range of pH in the midlyte. As described herein, the acidified midlyte solution removed from the midlyte region may be beneficially used in leaching operations or other process steps within the electrowinning system. In various embodiments, the midlyte pH may be established and/or maintained in a range of about 0 to about 2.5. In some particular embodiments, the midlyte pH may be established and/or maintained to be about 0, 0.1, 0.15, 0.2, 0.25, 0.3, 0.35, 0.5, 1, 1.5, 2, 2.5, or any range or discrete point between these values.

A microporous separator, proton exchange membrane, and/or any of various other types of materials can serve as the inner barrier, provided it performs the roles described herein. For example, the inner barrier should 1) significantly lower the flux of ferrous from the midlyte region to the anolyte region (and likewise slow the flux of ferric from anolyte to midlyte) while 2) remaining highly conducting to protons (low $H^+$ area-specific resistance (ASR)), and 3) have significantly lower electrolyte or water permeability compared to the outer barrier material to avoid pulling the anolyte into the midlyte at excessive rates. If an osmotic pressure between catholyte/midlyte/anolyte is maintained while the cell operates at steady state, the anolyte compartment can rebalance water loss osmotically by drawing water through the inner barrier as water is lost due to OER or evaporation.

To accommodate for instances of non-steady-state operation (e.g., start/stop cycles or other disruptions), passive re-balancing elements may also be employed, e.g., hydraulic shunts, spillways, or other pressure-balancing structures configured to between the midlyte and anolyte electrolytes. In various embodiments, hydraulic shunts may comprise apertures, tubes, conduits, or other fluid-carrying structures connecting the midlyte fluid to the anolyte fluid so as to balance undesired pressure differences between the volumes without transferring substantial quantities of fluid. One example hydraulic shunt structure may comprise an elongated tube extending through the inner barrier allowing volume and pressure transfer between the midlyte 130 and anolyte 126. In some embodiments, a spillway (e.g., 240 in FIG. 2) may be provided to allow excess anolyte 126 to flow into the midlyte 130.

In various embodiments, a vacuum tube 150 (or other structure) may be provided to remove solution from the midlyte region 130. As further described below, the midlyte solution 132 may be predominantly acid with a concentration of metal ions (e.g., predominantly $Fe^{2+}$ with a smaller concentration of $Fe^{3+}$). In some embodiments, there is no externally provided fresh solution added directly into either the midlyte or anolyte regions. The rate of removal of midlyte solution 132 may be selected based on a desired head-height difference and/or needs of the surrounding system. In various embodiments, midlyte may be removed at a rate of about 0.1 to about 10 liters per hour per square meter of cathode surface ($L/hr/m^2$), including all sub-ranges and discrete values in between. Depending on a desired hydrostatic pressure or rate of flow of catholyte through the outer barrier 112 into the midlyte region 130, a head-height difference of approximately 5 mm to approximately 150 mm or more may be maintained (including all sub-ranges and discrete values in between). The head-height difference between the catholyte and the midlyte is a function of parameters including but not limited to catholyte feed rate, midlyte withdrawal rate, and fluid transfer rate across the outer barrier, which may be determined by parameters such as, but not limited to, outer barrier O90 pore size, outer barrier pore open area, and outer barrier porosity.

In various embodiments, structures other than the illustrated dip tube may be used to remove midlyte 132 from the midlyte region 132. For example, a dip tube 150 may extend to any depth within the midlyte region 132. In some embodiments, the height of the midlyte 132 may be controlled by the depth of a dip tube, but in other embodiments, the midlyte height may be maintained by controlling a flow rate of midlyte with a closed-loop control system including a level sensor and/or based on one or more other variables such as plating current of an anode/cathode pair or an average plating current in a bath or an average plating current in two or more plating baths. In other embodiments a porous or perforated dip tube may extend to any depth in the midlyte for removing midlyte solution from the midlyte region. Alternatively, passive flow control structures such as spillover structures (e.g., dams, weirs, gates, or others) may be used to remove midlyte 132 from the midlyte region 130 while controlling a liquid level of the midlyte 132 to maintain a hydrostatic head 140 for a desired flow of catholyte 122.

Generally, fluid transport may be manipulated (e.g., by material selection, pumped flow rates, hydrostatic head differences, etc.) so that a flow rate of fresh feed solution into the catholyte region is approximately equal to the flowrate of solution extracted from the midlyte 132. In other embodiments, a plating bath may include a catholyte exit (e.g., a spillover structure or vacuum removal conduit) for maintaining a desired bath electrolyte level.

Osmosis-driven flow of water from the midlyte 132 into the anolyte 126 may be understood with reference to FIG. 1. The bulk concentration of solute in the catholyte 120 remains approximately constant as a steady addition of concentrated catholyte feed compensates for removed solution. Thus, the catholyte solute concentration and thereby the catholyte's osmotic pressure ($\Pi_{catholyte}$) remain substantially constant.

At steady state operation, water splitting and concomitant evolution of oxygen gas removes solvent ($H_2O$) and produces ions ($H^+$) which increases the solute concentration in the anolyte 124 and thus increases the osmotic pressure of the anolyte (↑Πanolyte). Thus, the anolyte 124 continuously acts as a "draw" solution pulling water from the midlyte 132 into the anolyte 124 to replenish the water lost due to OER. In effect, the cell can use the property of electrochemically driven forward osmosis to passively rebalance the anolyte 126 liquid level.

Overall, in various aspects, a DBA electroplating cell is characterized by a net flow of water from the aqueous catholyte to the midlyte (due to flow of electrolyte through the outer barrier), and net flow of water from the midlyte to the anolyte (due to migration of at least water through the inner barrier by osmosis in some configurations), with a quantity of midlyte being continuously or intermittently withdrawn from the midlyte region during operation of the cell. As water is consumed in the oxygen evolution reaction, water need not flow out of the anolyte region in any substantial volume.

During steady state operation of the DBA electroplating cell, in various aspects, fresh water (or electrolyte) need not be provided directly into the anolyte as long as the osmotic flow of water through the inner barrier from the midlyte to the anolyte is sufficient to replenish water consumed in the anolyte. Therefore, in some aspects, no water (or water-containing solution) is added directly into the anolyte. In various aspects, fresh water or fresh electrolyte solution may be intermittently or occasionally added to the anolyte, but the net flow of water from the midlyte to the anolyte is maintained as long as any flow of water from the anolyte to the midlyte is less than the flow of water from midlyte to anolyte.

To facilitate the above-described flows, the outer barrier 112 may beneficially be a porous material suitable for allowing liquid to flow through it with some resistance to the flow (e.g., a diaphragm such as a cloth bag). The outer barrier 112 is selected and/or configured to allow the catholyte solution 122 to flow through such that a rate or flux of catholyte 122 through the outer barrier 112 and into the midlyte region 130 is greater than a rate or flux of proton diffusion in the catholyte 122 and midlyte 132 solutions. This has the impact of minimizing transport of protons produced at the anode 104 to the cathode 102, thereby minimizing both acid attack on the plated metal and the parasitic hydrogen evolution reaction (HER) at the cathode 102.

The inner barrier 114 is preferably a material suitable for allowing aqueous proton diffusion (e.g., via Grotthuss mechanism) through it while substantially preventing bulk liquid flow. In some embodiments, the inner barrier may comprise a "microporous" material as defined herein (e.g., some separator materials produced for lead-acid battery applications, among other materials). The inner barrier 114 is selected and/or configured to facilitate unmitigated proton diffusion through it while mitigating diffusion or flux of (larger and less diffusively-mobile) metal cations therethrough. This difference in flux rates limits the concentration of metal (e.g., $Fe^{x+}$) cations in the anolyte 124, and thereby limits ferrous-to-ferric oxidation at the anode 104. The relatively low metal cation flux rate also limits the migration of any produced ferric back into the midlyte 132. At the same time, a high rate of proton flux through the inner barrier allows substantial migration of protons into the midlyte, thereby acidifying (i.e., decreasing the pH of) the midlyte solution 132.

In some embodiments, the inner barrier 114 may comprise a cation exchange polymer, either as one or more homogeneous layers (e.g., a proton exchange membrane or "PEM") or as a component of a heterogeneous membrane (e.g., a non-ionomer polymer matrix supporting cation exchange ionomer resin particles).

In various embodiments, the width of the catholyte region 122, i.e., the distance between the cathode 102 and the outer barrier of the anode assembly (including the anode, inner barrier, and outer barrier) may be consistently established or maintained by registration features or other structures ensuring consistent positioning of the cathodes and anode assemblies within a cell or plating bath. In some embodiments, the width of the catholyte region (i.e., the distance between a cathode surface and the nearest outer barrier) is selected from the range of approximately 5 mm to approximately 50 mm. Generally, the catholyte region width may be a balance between reducing the width to limit ionic or ohmic resistance through the electrolyte while allowing removal and insertion of the cathode from/into the plating bath with minimal mechanical impact on the outer barrier or anode assembly.

In some embodiments, a minimum and/or maximum width of the midlyte region 130 may be established and/or maintained by spacing structures placed between the inner barrier 114 and the outer barrier 112. In some embodiments, the volume of the midlyte region 130 may impact a rate of proton removal from the midlyte space. For example, a narrower midlyte region 130 may correlate with a faster liquid replacement rate within the midlyte region 130. Additionally, a narrower midlyte region reduces path length of ionic transport thereby reducing ionic or ohmic resistance. Therefore, the dimensions of the midlyte region 130 and the various flow rates may be varied to achieve a desired flow rate of solution entering and leaving the midlyte region 130 to minimize diffusion of protons across the midlyte region 130. In various embodiments, the width of the midlyte region is approximately 1 mm to approximately 10 mm.

Figure 2:
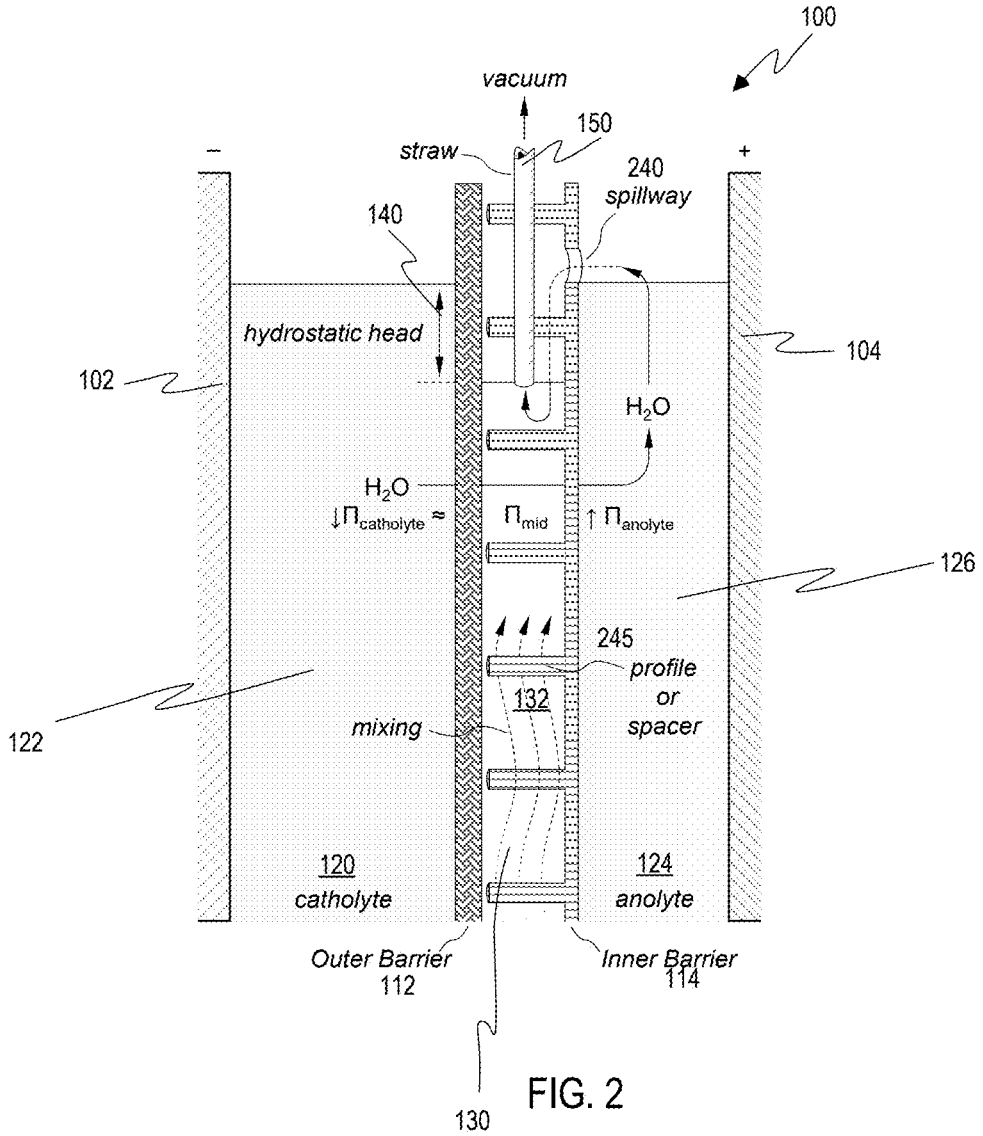
FIG. 2 is a schematic cross-sectional illustration of a portion of a double barrier anode cell comprising spacers between an outer barrier and an inner barrier.

FIG. 2 illustrates an example DBA cell comprising spacers 245 within the midlyte region 130. In various embodiments, spacers 245 may serve to maintain a consistent spacing between the inner barrier 114 and the outer barrier 112 and/or to encourage mixing of solution within the midlyte region 130 (e.g., driven by natural convection and/or by circulation pumps, or by flow induced by the midlyte removal conduit 150). In various configurations, spacers 245 may comprise independent sheets of material. Example spacer materials may include glass mesh or glass mat sheets and woven or non-woven sheets of substantially inert, non-conductive materials including polymers, silica, metal oxides, or others. In other examples, spacers may comprise features integral with the inner barrier & and/or the outer barrier 112, such as ribs, channels, scallops, knobs, prismatic structures, or others. In some embodiments, spacers of any of the above types may also be provided between the inner barrier 114 and the anode and/or between the outer barrier and the cathode.

In some embodiments, one or more oxidative protection materials may be provided between the anode 104 and the inner barrier 114 in order to limit the impact of oxidizing species (e.g., $O_3$, $O_x$, radicals) on the inner barrier materials which may be susceptible to deleterious oxidation. Impact of the oxidizing species on the inner barrier 114 may be decreased by slowing their diffusion from the anode 104 to the inner barrier 114, or by providing a sacrificial material to react with the oxidizing species before they reach the inner barrier 114. In various embodiments, oxidative protection layers or materials may be integral with or in addition to spacers 245. Example oxidative protection materials may include organic materials such as polymer or cellulose meshes or sheets. In some embodiments, a protection material may be provided between the anode 104 and inner barrier 114 to avoid or minimize disruption of the inner barrier by oxygen gas bubbles evolving at the anode.

In some embodiments, a double-barrier anode assembly may include one or more structural elements arranged to mechanically support the inner or outer barriers. Structural elements may comprise prismatic frames (e.g., as described below with reference to FIG. 4), or planar frame structures (e.g., as described below with reference to FIG. 5 and FIG. 6. Structural elements may comprise wide open lattice structures, sheets of mesh, or others. Structural support elements may generally be configured to provide mechanical support with minimal blockage of electrochemically active surface area of the anodes or cathodes.

In some embodiments, the inner barrier 114 and/or the outer barrier 112 may be constructed in the form of an enclosed "bag" or envelope that surrounds the structure(s) within it on all sides with an opening at the top. In some embodiments, the top opening may be sealed to hanger bars or other structures.

In other embodiments, the inner barrier 114 and/or outer barrier 112 may be configured as planar structures, and the midlyte and anolyte regions may be established by a sealed stack-up structure (e.g., as described below with reference to FIG. 4 and FIG. 5). In some embodiments, a mix of planar and bag-shaped barriers may be used.

Outer barrier bags may be available commercially or may be made by sewing a porous (e.g., woven or non-woven) material into a bag shape. Inner barrier materials may be made into bag shapes by any suitable process such as sewing, heat sealing (thermal bonding or thermal welding), ultrasonic welding, adhesive bonding, solvent welding, or using mechanical closures such as crimps, clamps, frames, or combinations of these or other methods.

Figure 3A:
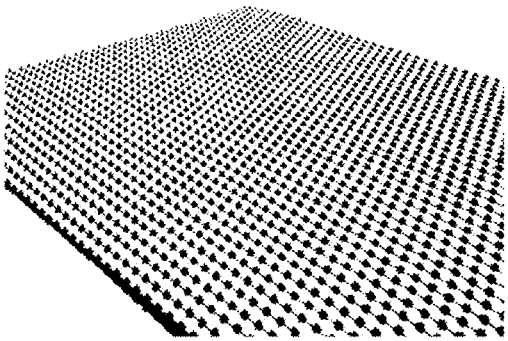
FIG. 3A-FIG. 3D are photographs showing commercially available materials and components that may be adapted for use in a double barrier anode assembly.
Figure 3C:
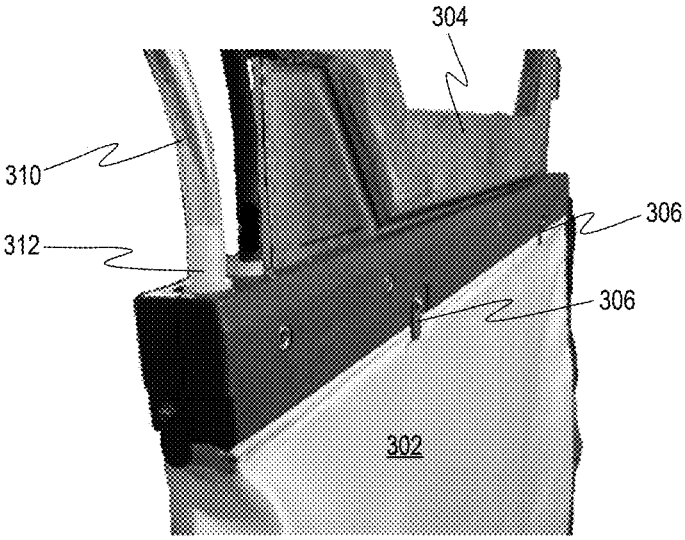
Figure 3D:
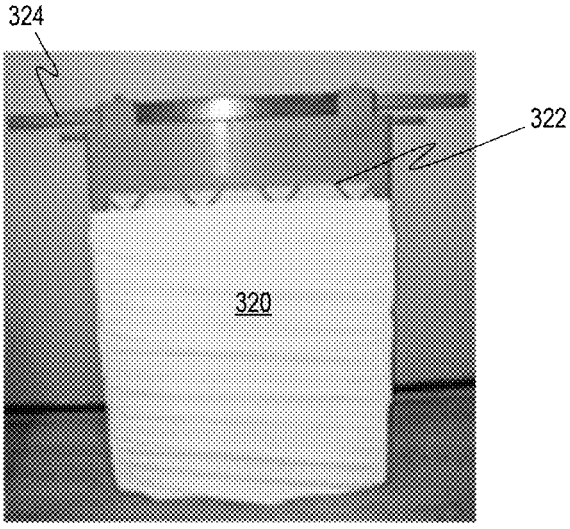
Figure 3B:
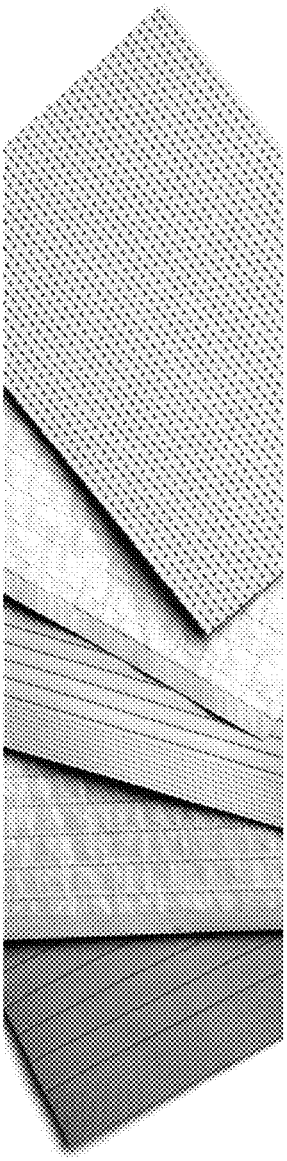

FIG. 3A-FIG. 3D illustrate some commercially available materials that may be used as components in a DBA cell. For example, FIG. 3A and FIG. 3B illustrate examples of commercially available microporous separator materials that may be useful as inner barrier and/or outer barrier materials. The various examples in FIG. 3A and FIG. 3B include features (knobs, ribs, channels, etc.) that may be useful as spacers and/or for providing space for oxygen bubble egress. FIG. 3C illustrates a single barrier bag 302 clamped to a hangar bar 304 with fasteners 306 and having a vacuum tube 310 extending from a top port 312. FIG. 3D illustrates a barrier bag 320 partially covering a frame 322 with an upper hangar bar 324. In various embodiments, these or other commercially available materials and structures may be adapted for use in assembling a double barrier anode assembly as described herein. Some example double-barrier anode cartridge assembly configurations are described with reference to FIG. 4, FIG. 5, and FIG. 6.

Figure 4:
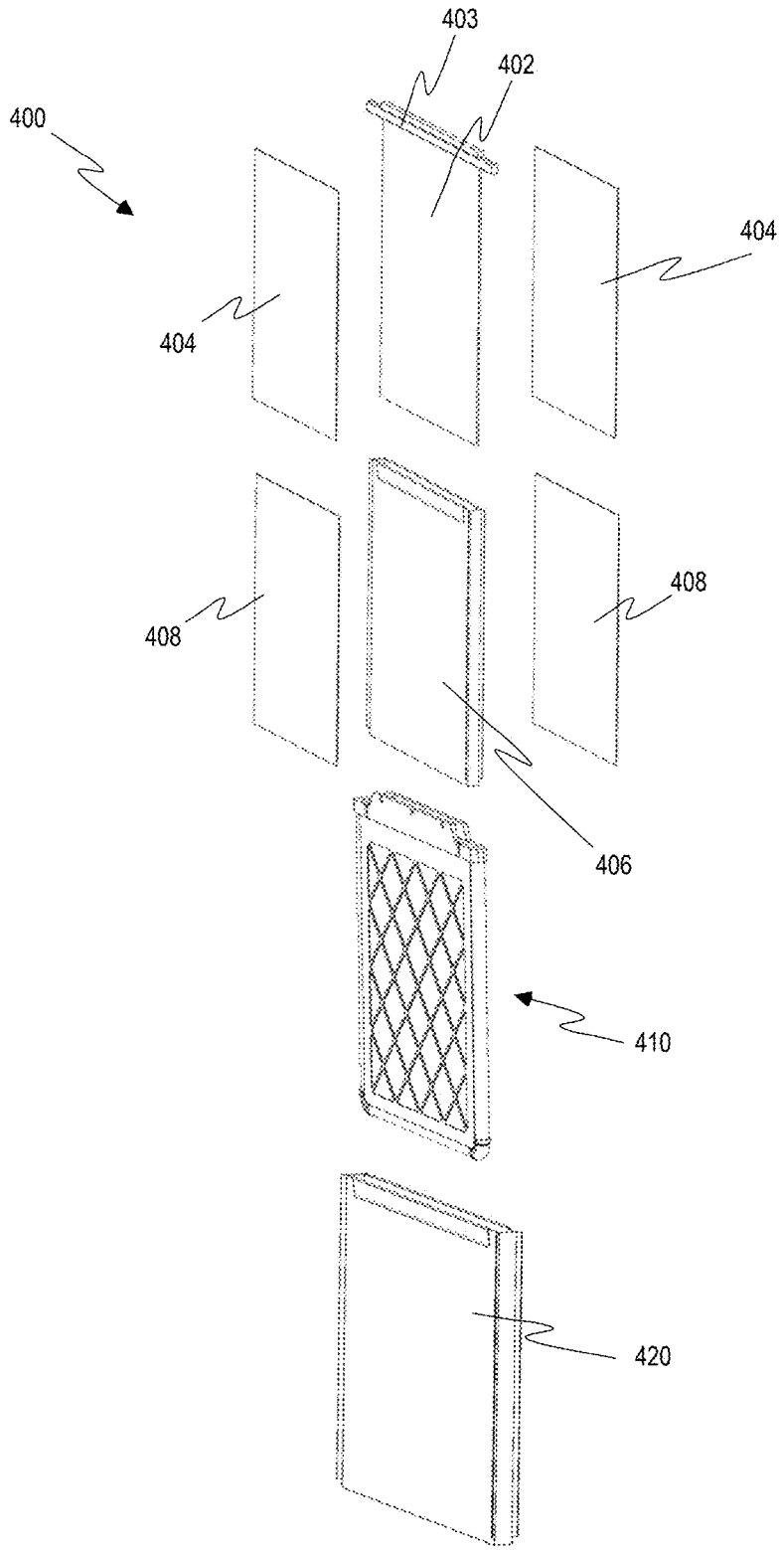
FIG. 4 is an assembly view showing components of one embodiment of a double-barrier anode cartridge assembly.

FIG. 4 illustrates an example assembly of components for a double-barrier anode cartridge assembly 400 in which both the inner barrier and the outer barrier are configured in "bag" or "envelope" configurations such that they surround their interior components on all sides except the top which may be secured to a hanger bar or other structure so as to form a removable cartridge assembly. A removable double-barrier anode assembly provides the benefit of simple removal from the plating bath to allow for replacement and/or maintenance of the anode cartridge and/or its components.

With reference to FIG. 4, an anode plate 402 (e.g., of any of the materials or configurations described herein) may include a hanger bar 403 from which the assembly may be suspended in a plating bath. Inner spacers 404 (e.g., of any of the materials or configurations described herein) may be positioned on the outer faces of the anode plate 402. The anode plate 402 and spacer layers 404 may be inserted into an inner barrier bag 406 (e.g., of any of the materials or configurations described herein). Outer spacer layers 408 may be layered onto the outer faces of the inner barrier bag 406, and in some embodiments, the inner barrier bag 406 and spacers 408 may be placed within a frame 410. In some embodiments, the outer spacers 408 may be omitted and the frame may be configured to provide spacing between the inner barrier bag and the outer barrier bag. The frame 410 with all of the above components may then be placed within the outer barrier bag 420.

Figure 5:
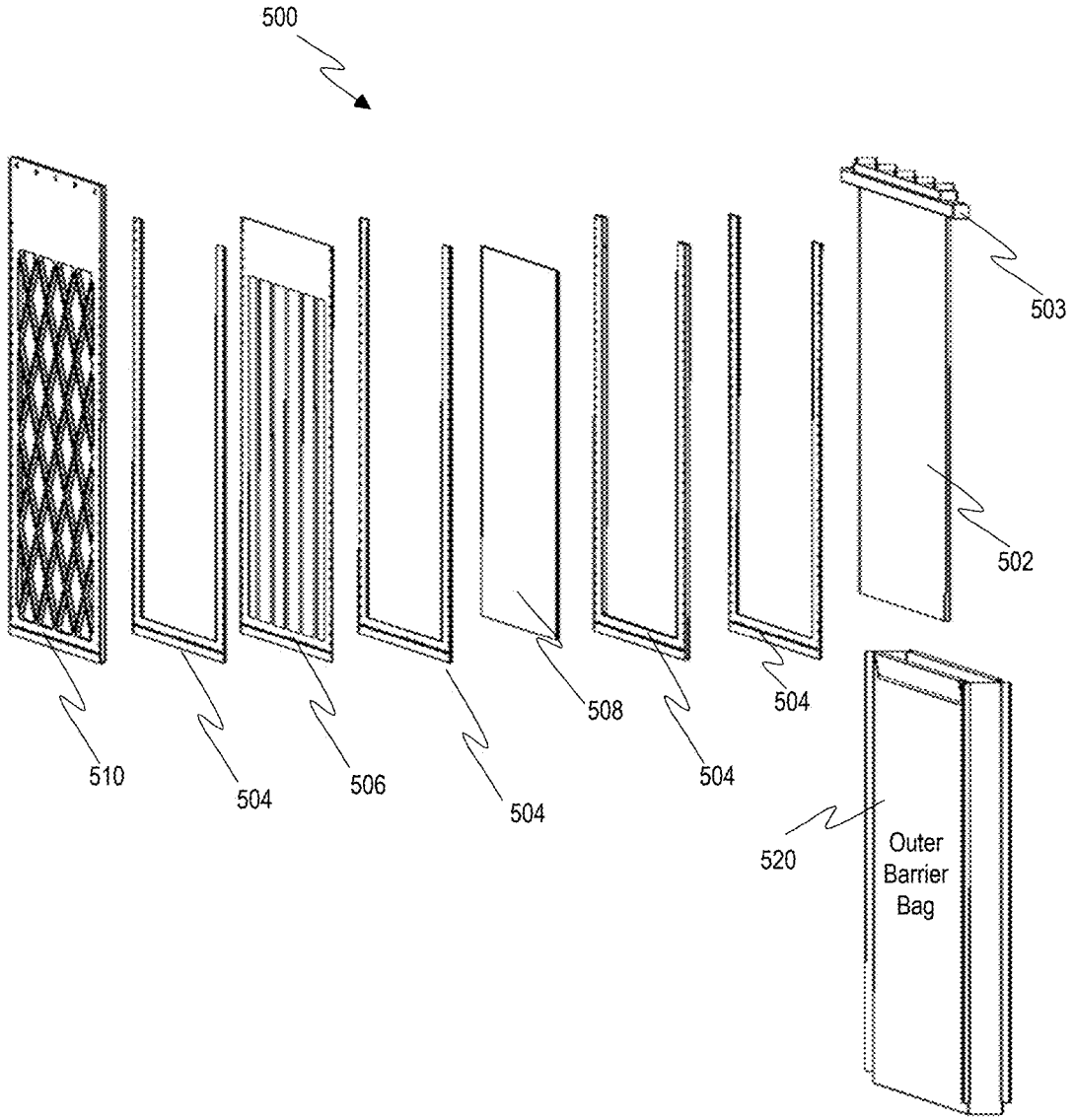
FIG. 5 is an assembly view showing components of another embodiment of a double-barrier anode cartridge assembly.

FIG. 5 illustrates an embodiment of a single-sided assembly of a double barrier anode cartridge 500 with a planar inner barrier 506 sealed to an anode plate 502 by gaskets 504. In some embodiments, a single-sided anode assembly may be desired, for example, for anodes to be located at peripheral ends of a plating bath (i.e., with no corresponding cathodes adjacent to the outer face of the single-sided anode. Alternatively, the assembly of FIG. 5 may be produced as a double-sided anode (e.g., to be placed in between a cathodes adjacent to both faces) by mirroring the components 504 to 510 on the opposite face of the anode plate 502.

A spacer 508 (e.g., of any of the materials or configurations described herein) may be positioned adjacent the anode plate 502, and may optionally be sealed to the anode plate by one or more gaskets 504. An opposite face of the spacer 508 may be sealed to a planar inner barrier 506 (e.g., one or more layers of any of the inner barrier materials or configurations described herein). In the illustrated configuration, the outer face of the inner barrier layer 506 may be sealed to a frame layer 510 by a gasket 504. The assembly of anode plate 502, gasket(s) 504, spacer(s) 508, inner barrier(s) 506, and outer frame(s) 510 may be inserted into an outer barrier bag 520 which may be sealed (e.g., by clamps, fasteners, adhesives or other structures) to a hangar bar 503.

Figure 6:
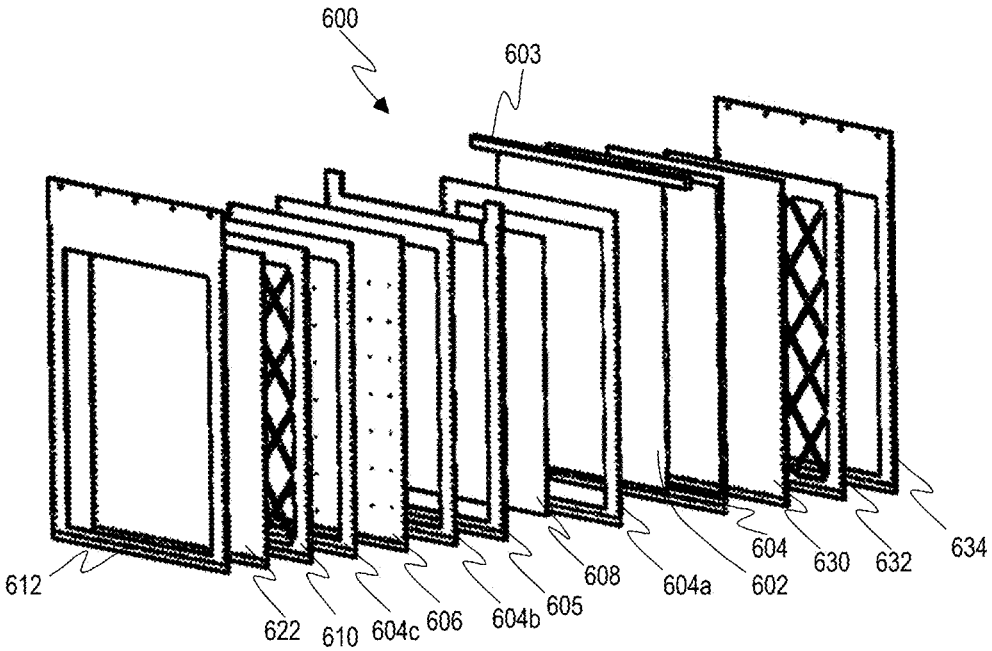
FIG. 6 is an assembly view showing components of another embodiment of a double-barrier anode cartridge assembly.

FIG. 6 illustrates a stacked-layer DBA assembly which is similar to the assembly of FIG. 4, but includes a planer outer barrier layer 622 sealed to the inner barrier 606 by gaskets 604 and an outer frame window 612 instead of an outer barrier bag (as shown in FIG. 4). FIG. 6 illustrates a single-sided anode assembly as described above with reference to FIG. 5, and may similarly be configured as a double-sided anode assembly by mirroring inner barrier, gasket, spacer, and frame components on the opposite side of the anode plate 602.

An inner spacer layer 608 may be sealed to the anode plate 602 by a gasket 604. In some embodiments, an intermediate frame layer 605 may be used to create an anolyte region volume between the spacer and the inner barrier layer 606, which may be sealed to the intermediate frame layer 605 by a gasket 604*b*. In some embodiments a mesh frame layer 610 may be used to create a midlyte region volumetric space between the inner barrier layer 606 and the outer barrier layer 610. The mesh shape of the mesh frame layer 610 may provide mechanical support to the inner barrier layer 606 to prevent it from deflecting towards the outer barrier layer 622 (and similarly preventing the outer barrier layer 622 from deflecting inwards toward the inner barrier layer 606), which would undesirably cause inconsistency in the volume of the midlyte region. An outer window frame layer 612 may be used to secure the outer barrier layer 622 to the assembly. In various embodiments, any number of other gaskets or other sealing surfaces may be used in any regions of a stack-up configuration in addition to or subtracting from the configurations illustrated in any of FIG. 4, FIG. 5, and/or FIG. 6.

The anode assembly of FIG. 6 is single-sided, the "back side" of the assembly includes structures whose purpose is mainly to seal and secure the anode plate and other components to the hanger bar for support and transport. The non-active side of the anode plate 602 may be covered by an inert backer sheet 630 made of any desired non-reactive material, such as a polymer (e.g., CPVC), glass, or others. The backer sheet 630 may be sealed to the anode plate 602 by a gasket 604. A second mesh frame layer 632 and a second outer window frame layer 634 may enclose the back side of the anode. The assembly of FIG. 6 may also be configured as a double-sided anode assembly by mirroring the inner barrier, gaskets, spacers, and frame components on the "back" side of the anode plate 602.

Figure 7:
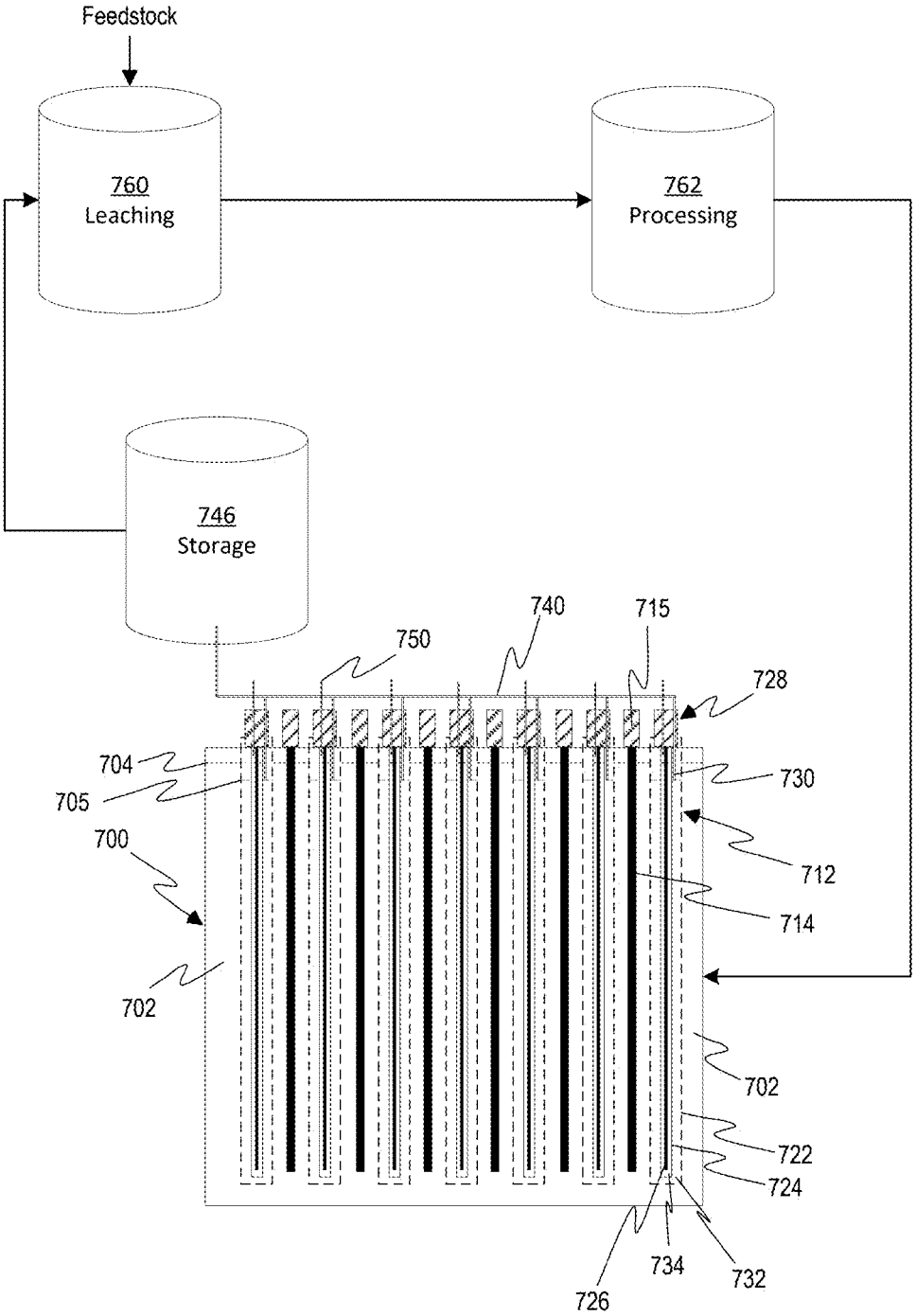
FIG. 7 is a schematic illustration of an electrowinning system, including a cross-sectional view of an electrowinning bath showing cathodes and double-barrier anodes and its connections to other system components.

FIG. 7 illustrates a cross-sectional view of a plating bath 700 filled with catholyte 702 to a liquid surface level 704. Submerged in the bath 704 is a series of cathodes 714 suspended from hanger bars 715 and double barrier anode cartridge assemblies 712 ("cartridge"). Each cartridge 712 includes an outer barrier 722 (shown as a "bag" surrounding the inner components), an inner barrier 724 (also shown as a bag surrounding inner components), an anode electrode 726, a hanger bar 728, and a midlyte removal (e.g., vacuum) tube 730 extending into the midlyte region 732 defined as the volume between the outer barrier 722 and the inner barrier 724.

The anolyte region 732 lies within the volume inside the inner barrier 724 and contains an anolyte solution 734. The anolyte solution 734 is illustrated at the same level 704 as the catholyte level, but may be maintained at a higher or lower level as described herein. Midlyte removal tubes 730 are provided for removal of midlyte solution from the midlyte region. The midlyte removal tubes 730 are shown extending through a portion of the anode cartridge hanger bar structure 728, but may be configured in an suitable manner. In some embodiments, the midlyte removal tubes may be joined to a manifold or conduit 740 for directing removed midlyte solution to a reservoir 746. The midlyte level 705 is illustrated as being aligned with the bottom of midlyte removal tubes 730, but in various configuration the midlyte level may be managed independently of the height of the removal tube openings.

Because the midlyte solution will be substantially acidified by the movement of protons from the anolyte as described above, the midlyte solution may be useful as a lixiviant for leaching a feedstock material to obtain a leach solution from which further metals may be recovered by electrowinning in a plating bath 700. In various aspects, withdrawn midlyte solution is provided to a leaching subsystem 760, which may include any suitable features (e.g., leaching tanks, reactors, or other vessels), including features described in the Wustite application or the Reductive Leach application. In various aspects, withdrawn midlyte solution is provided directly or indirectly to a leach vessel. For example, leaching may comprise contacting a solid feedstock material with the withdrawn midlyte solution, where the solid feedstock may include one or more ores, waste materials, scrap materials, or others. In various aspects, withdrawn midlyte solution is directly or indirectly provided to a ferric reduction reactor, which may comprise an acid regenerator cell and/or a reductive leach reactor, such as described in the Wustite application or the Reductive Leach application.

In some embodiments, a pregnant leach solution "PLS" exiting a leaching operation 760 may be further processed in a processing step 762. In various embodiments, processing 762 may comprise one or more process steps for altering a composition of the leach solution prior to electroplating a metal from the solution exiting the processing step 762. For example, the leach solution may be processed for the removal of impurities by precipitation, solvent extraction, concentrated by distillation, mixed with additional reactants, or otherwise processed through other hydrometallurgical processes.

Oxygen generated at the anodes may be removed through gas conduits 750 which are schematically shown extending through the hanger bars, but may be configured in any manner as desired. For example, evolved oxygen may be allowed to collect in a headspace above the bath, and may be removed via a vacuum hood positioned above the bath. Removed oxygen may be processed as needed and then vented to atmosphere or directed to another use if needed.

In various aspects, a feedstock material is thermally reduced prior to performing leaching thereof. Among other advantages of thermally reducing a feedstock material, doing so decreases some operating costs and burdens in subsequent processes. For example, via aspects of thermal reduction disclosed herein, it is possible to achieve a ferrous-rich leachate solution, having a high post-leach ferrous-to-ferric concentration ratio (e.g., greater than or equal to 100:1), as a result of the composition of the thermally-reduced material and without necessarily requiring a post-leach and pre-electroplating chemical or electrochemical process to achieve such ferrous-to-ferric concentration ratio. In various aspects and configurations disclosed herein, a ferric reduction reactor may be employed after electroplating and/or after leaching to convert at least a portion of ferric ions generated during electroplating to ferrous ions. Ferric reduction reactors may comprise chemical reactants and/or electrochemical cells configured cause reduction of aqueous ferric ($Fe^{3+}$) ions to form aqueous ferrous ($Fe^{2+}$) ions.

In various embodiments, a feedstock material may include an iron source material in which at least some of the iron is in an oxidized state. For example, the feedstock material may comprise one or more iron ores, one or more iron oxides, one or more iron carbonates, one or more iron-based metals, one or more other iron metal or iron-containing materials that are products or byproducts of ironmaking or steelmaking processes (e.g., slags, dusts, off-fall, scrap, pickling liquors), or any combinations or mixtures of any of these in naturally-occurring states, man-made states, and/or beneficiated and/or purified states. For example, the feedstock material may be predominantly an iron ore with a net oxidation state of greater than 2.0, or greater than 2.0 and less than or equal to approximately 3.0. For example, some iron feedstock materials are predominantly an iron ore including one or more of goethite, hematite, magnetite, or a combination of these. For example, in some embodiments the iron feedstock material is predominantly hematite, which may correspond to a net iron oxidation state of about 3. As an illustrative example, a feedstock may comprise 50 mol. % $FeTiO_3$ and 50 mol. % magnetite, which may correspond to a net iron oxidation state of about 2.33. In a pure magnetite material, approximately ⅔ of the iron is in the Fe(Ill) state and approximately ⅓ of the iron is in the Fe(II) state, corresponding to a net oxidation state of about 2.67.

In some embodiments, the iron-containing feedstock material is pre-conditioned or prepared prior to being thermally reduced, where the pre-conditioning may include one or more processes, such as but not limited to milling, grinding or other comminution to reduce the feedstock particle size and/or make the particle size more uniform or less polydisperse. Pre-conditioning may also include other mineral treatment or beneficiation steps or processes, including rejection of gangue, magnetic separation, flotation, classification, gravimetric separation, or others.

Following the thermal reduction and/or other preconditioning steps, the prepared material may be leached, as part of a leaching subsystem, to obtain a solution containing dissolved metallic species leached from the prepared feedstock. The preparation steps may beneficially be operated so as to produce a leach solution containing iron predominantly (or substantially entirely) in a "ferrous" ($Fe^{2+}$) state.

In various aspects herein, the feedstock material may be thermally-reduced sufficiently to achieve a net iron oxidation state less than about 2.0 in the thermally-reduced material (pre-leach material). In various aspects, the target net oxidation state may be greater than or equal to approximately 1.6 but less than 2.0. In some aspects, the thermally-reduced material is predominantly wüstite (FeO), optionally with the balance being predominantly a combination of an iron metal ($Fe^0$) and magnetite. In some aspects, the thermally-reduced material is predominantly a combination of wüstite (FeO) and iron metal ($Fe^0$) with little or no magnetite. In some aspects, the thermally-reduced material is predominantly a combination of wüstite (FeO), iron metal ($Fe^0$), and magnetite. In some aspects, the thermally-reduced material is predominantly a combination of magnetite and iron metal ($Fe^0$). In some aspects, the thermally-reduced material is characterized by a composition having a quantity of $Fe^0$ selected from the range of greater than 0 mol. % $Fe^0$ to less than or equal to approximately 50 mol. % $Fe^0$, wherein any value and any range therebetween is explicitly contemplated and disclosed herein. In some aspects, a target thermally-reduced material composition may have a quantity of FeO approximately equivalent to a quantity of Fe(Ill) in the material. For example, a thermally-reduced material containing magnetite may also contain a target quantity of $Fe^0$ approximately equal to ⅔ the quantity of magnetite.

In various aspects, a pre-leach material is provided to a leaching subsystem. The leaching subsystem performs dissolution or leaching of a pre-leach material, in an aqueous acidic solution to produce an aqueous ferrous-rich leachate. The pre-leach material comprises the thermally-reduced material, but is not necessarily limited to the thermally-reduced material. The acid in the aqueous acidic solution is optionally predominantly sulfuric acid ($H_2SO_4$), but may also include any other acid suitable for leaching the input material as described herein.

The pre-leach material, in addition to comprising the thermally-reduced material, may optionally further comprise one or more other iron-containing materials, such as, but not limited to, one or more iron-based metal materials in one or more forms (such as, but not limited to: iron dust, iron powder, one or more steel materials or steelmaking byproducts (including but not limited to: iron dust, steel slag, iron powder, stainless steel, carbon steel, tool steel, crucible steel, spring steel, alloy steel, maraging steel, high-speed steel, weathering steel, and any variations and grades thereof), mill scale, cast iron, gray iron, white iron, ductile iron, malleable iron, wrought iron, one or more iron-carbon alloys or steel materials, one or more other iron metal or iron-based materials, an iron ore, such as but not limited to naturally-occurring wüstite, or ferrous carbonates or ferrous silicates. For example, the FeO in the pre-leach material may be a combination of FeO from the thermally-reduced material and FeO sourced otherwise, such as by including a steelmaking slag, which contains significant amount of FeO, in the pre-leach material. The pre-leach material optionally also comprises $Fe^0$ from sources other than the thermally-reduced material, such as scrap steel, scrap iron, direct reduced iron, or a combination thereof.

Following the leaching step, the leach solution may be treated to remove at least some impurities from the solution, as part of an impurity removal subsystem. The purified solution may then be directed to an electrowinning cell, according to aspects and embodiments herein, in which dissolved iron is electroplated from the solution. As noted elsewhere, the removed midlyte solution may be provided to the leaching subsystem, such as directly to a leaching tank or to a ferric reduction reactor.

In some aspects, the target predominant iron ion species in the ferrous-rich leachate is $Fe^{2+}$. Optionally, in aspects herein, the ferrous-rich leachate is characterized by a ratio of concentrations of $Fe^{3+}$ ions to $Fe^{2+}$ ions being less than or equal to approximately 0.01, optionally less than or equal to approximately 0.009, optionally less than or equal to approximately 0.0075, optionally less than or equal to approximately 0.005, optionally less than or equal to approximately 0.0025, optionally less than or equal to approximately 0.001, or optionally the ratio can be greater than or equal to 0.0075, 0.005, 0.0025, or 0.001 and such values can be combined in any manner to form a range, such as 0.001 to 0.01.

To produce the ferrous-rich leachate having primarily $Fe^{2+}$ ions, parameters such as pH of the acidic solution, temperature of the acidic solution, and composition of the thermally-reduced material may be adjusted or selected accordingly. Wustite, or ferrous oxide (FeO), from the thermally-reduced material may generally dissolve to produce predominantly ferrous ($Fe^{2+}$) ions and some ferric ($Fe^{3+}$) ions in the aqueous acidic solution, depending on the sub-stoichiometry of the wüstite. Magnetite from the thermally-reduced material will generally dissolve to produce a combination of ferrous and ferric ($Fe^{3+}$) ions in the aqueous acidic solution, and $Fe^0$, in the form of one or more iron metal and/or iron-based metal materials, will generally react with and reduce aqueous ferric ions to ferrous ions in the aqueous acidic solution. Therefore, selecting particular ratios of these constituents in combination with other leaching parameters can achieve a range of desired ferrous/ferric ratios in a resulting leach solution.

In various aspects, the leaching process is optionally performed at an elevated temperature. For example, the leaching temperature may be less than or equal to 100° C., such as a temperature selected from the range of 50° C. to 80° C. The resulting ferrous-rich leachate may have a target concentration of ferrous ions, or for example ferrous sulfate, selected from the range of approximately 0.1 mol/L to approximately 2 mol/L (including all discrete values within that range), although any other ferrous ion concentrations are contemplated within this disclosure.

In various aspects, the ferrous-rich leachate is provided to an impurity removal subsystem for removing various non-iron impurities and producing a purified ferrous-rich leachate. Some components of the pre-leach material or the thermally-reduced material, such as silica and quartz, may not dissolve in the aqueous acidic solution and may instead be removed as undissolved solids or precipitates. Impurities that do dissolve may then be removed from the ferrous-rich leachate via the impurity removal subsystem such as by a precipitation and filtration process driven by a pH shift as described in the '604 patent. For example, one or more bases, such as but not limited to NaOH, KOH, and $NH_4OH$, can be added to the leachate to increase the pH, such as to greater than 3, to precipitate impurities such as aluminum and phosphorus compounds. Alternatively or in addition, metallic iron may be used increase the solution pH. Alternatively, other impurity removal methods such as solvent extraction, cementation, or other methods may be used which are representative of any impurity removal subsystem according to aspects herein.

In various aspects, the purified ferrous-rich leachate is fed, as fresh catholyte or fresh plating solution, to the plating bath of an iron electroplating cell according to any aspects and embodiments herein.

ASPECTS AND EMBODIMENTS

Various aspects are contemplated and disclosed herein, a plurality of which is set forth in the paragraphs below. It is explicitly contemplated and disclosed that any aspect or portion thereof can be combined to form an aspect. In addition, it is explicitly contemplated and disclosed that: any reference to Aspect 1 includes reference to Aspects 1a, 1b, and any combination thereof (any reference to an aspect includes reference to that aspect's lettered versions). Moreover, the terms "any preceding aspect" and "any one of the preceding aspects" means any aspect that appears prior to the aspect that contains such phrase (for example, the sentence "Aspect 32: The method or system of any one of the preceding Aspects . . . " means that any aspect prior to aspect 32 is referenced, including letter versions, including aspects 1a through 31). For example, it is contemplated and disclosed that, optionally, any method, any step, any system, any subsystem, any composition, etc., according to any of the below aspects may be useful with or combined with any other aspect(s) provided below. Further, for example, it is also contemplated and disclosed that any embodiment or aspect described above may, optionally, be combined with any of the below listed aspects.

Aspect 1a: An iron electrowinning system comprising:

an iron electrowinning cell comprising:

a plating bath containing a catholyte having dissolved iron ions therein;

a cathode in contact with the catholyte and configured to electrodeposit iron metal thereon via electrochemical reduction of the dissolved iron ions;

an anode configured to produce oxygen gas thereon via electrochemical water oxidation;

an inner barrier in the form of a bag ("inner barrier bag") at least partially surrounding the anode and defining an anolyte-region containing an anolyte in contact with the anode; and an outer barrier in the form of a bag ("outer barrier bag") at least partially surrounding the inner barrier bag and defining a midlyte region containing a midlyte between the inner barrier bag and the outer barrier bag.

Aspect 1b: A method of making electrolytic iron in an iron electrowinning system comprising:

a three-chamber iron electrowinning cell comprising:

a plating bath containing a catholyte having dissolved iron ions therein;

a cathode in contact with the catholyte;

an anode in contact with an anolyte;

an outer barrier in the form of a bag ("outer barrier bag") at least partially surrounding the anode and defining an anolyte-region containing the anolyte in contact with the anode; and an inner barrier in the form of a bag ("inner barrier bag") at least partially surrounding the inner barrier bag and defining a midlyte region containing a midlyte between the inner barrier bag and the outer barrier bag;

the method comprising:

maintaining a pressure difference between the catholyte and the midlyte across the outer porous barrier sufficient to cause catholyte to flow through the outer porous barrier into the midlyte region;

removing a portion of midlyte from the midlyte region;

electrodepositing iron metal on the cathode; and electrochemically oxidizing water and evolving oxygen at the anode.

Aspect 2a: An iron electrowinning system comprising:

an iron electrowinning cell comprising:

a plating bath containing a catholyte having dissolved iron ions therein; and a cathode in contact with the catholyte and configured to electrodeposit iron metal thereon via electrochemical reduction of the dissolved iron ions;

a removable anode-assembly comprising:

an anode configured to produce oxygen gas thereon via electrochemical water oxidation;

an inner barrier defining an anolyte-region between the inner barrier and the anode, the anolyte-region containing an anolyte in contact with the anode; and an outer barrier defining a mid-region between the outer barrier and the inner barrier, the mid-region containing a midlyte, the midlyte being separated from the anolyte by the inner barrier and separated from the catholyte by the outer barrier;

wherein the anode, inner barrier, and outer barrier are all suspended from a common hanger bar.

Aspect 2b: A method of making electrolytic iron in an iron electrowinning system comprising:

a three-chamber iron electrowinning cell comprising:

a plating bath containing a catholyte having dissolved iron ions therein;

a cathode in contact with the catholyte; and a removable anode-assembly comprising:

an anode in contact with an anolyte;

an inner barrier defining an anolyte-region between the inner barrier and the anode, the anolyte-region containing an anolyte in contact with the anode; and an outer barrier defining a mid-region between the outer barrier and the inner barrier, the mid-region containing a midlyte, the midlyte being separated from the anolyte by the inner barrier and separated from the catholyte by the outer barrier;

wherein the anode, inner barrier, and outer barrier are all suspended from a common hanger bar;

the method comprising:

maintaining a pressure difference between the catholyte and the midlyte across the outer porous barrier sufficient to cause catholyte to flow through the outer porous barrier into the midlyte region;

removing a portion of midlyte from the midlyte region;

electrodepositing iron metal on the cathode; and electrochemically oxidizing water and evolving oxygen at the anode.

Aspect 3a: An iron electrowinning system comprising:

an iron electrowinning cell comprising:

a plating bath containing a catholyte having dissolved iron ions therein;

a cathode in contact with the catholyte and configured to electrodeposit iron metal thereon via electrochemical reduction of the dissolved iron ions;

an anode configured to produce oxygen gas thereon via electrochemical water oxidation;

an inner barrier defining an anolyte-region between the inner barrier and the anode, the anolyte-region containing an anolyte in contact with the anode; and an outer barrier defining a mid-region between the outer barrier and the inner barrier, the mid-region containing a midlyte, the midlyte being separated from the anolyte by the inner barrier and separated from the catholyte by the outer barrier;

wherein each of the inner barrier and the outer barrier is porous; and wherein the cell comprises a net flow of water from the midlyte to the anolyte during operation.

Aspect 3b: A method of making electrolytic iron in an iron electrowinning system comprising:

a three-chamber iron electrowinning cell comprising:

a plating bath containing a catholyte having dissolved iron ions therein;

a cathode in contact with the catholyte;

an anode in contact with an anolyte;

an inner barrier defining an anolyte-region between the inner barrier and the anode, the anolyte-region containing an anolyte in contact with the anode; and an outer barrier defining a mid-region between the outer barrier and the inner barrier, the mid-region containing a midlyte, the midlyte being separated from the anolyte by the inner barrier and separated from the catholyte by the outer barrier;

the method comprising:

maintaining a pressure difference between the catholyte and the midlyte across the outer porous barrier sufficient to cause catholyte to flow through the outer porous barrier into the midlyte region;

removing a portion of midlyte from the midlyte region;

establishing a net flow of water from the mid-region to the anolyte region across the inner barrier;

electrodepositing iron metal on the cathode; and electrochemically oxidizing water and evolving oxygen at the anode.

Aspect 3c: The method of Aspect 2a comprising maintaining (e.g., during steady state condition of the cell) a net flow of water from the mid-region to the anolyte region across the inner barrier.

Aspect 3d: The method of Aspect 3b or 3c, comprising transferring water from the mid-region to the anolyte region across the inner barrier at a rate sufficient to replace water consumed and/or lost from the anolyte.

Aspect 4a: An iron electrowinning system comprising:

an iron electrowinning cell comprising:

a plating bath containing a catholyte having dissolved iron ions therein;

a cathode in contact with the catholyte and configured to electrodeposit iron metal thereon via electrochemical reduction of the dissolved iron ions;

an anode configured to produce oxygen gas thereon via electrochemical water oxidation;

an inner barrier defining an anolyte-region between the inner barrier and the anode, the anolyte-region containing an anolyte in contact with the anode;

an outer barrier defining a mid-region between the outer barrier and the inner barrier, the mid-region containing a midlyte, the midlyte being separated from the anolyte by the inner barrier and separated from the catholyte by the outer barrier; and a first spacer between the outer barrier and the inner barrier and defining the width of the mid-region;

wherein each of the inner barrier and the outer barrier is porous.

Aspect 4b: A method of making electrolytic iron in an iron electrowinning system comprising:

a three-chamber iron electrowinning cell comprising:

a plating bath containing a catholyte having dissolved iron ions therein;

a cathode in contact with the catholyte;

an anode in contact with an anolyte;

an inner barrier defining an anolyte-region between the inner barrier and the anode, the anolyte-region containing an anolyte in contact with the anode;

an outer barrier defining a mid-region between the outer barrier and the inner barrier, the mid-region containing a midlyte, the midlyte being separated from the anolyte by the inner barrier and separated from the catholyte by the outer barrier; and a first spacer between the outer barrier and the inner barrier and defining the width of the mid-region;

the method comprising:

maintaining a pressure difference between the catholyte and the midlyte across the outer porous barrier sufficient to cause catholyte to flow through the outer porous barrier into the midlyte region;

removing a portion of midlyte from the midlyte region;

electrodepositing iron metal on the cathode; and electrochemically oxidizing water and evolving oxygen at the anode.

Aspect 5: The system or method of any of one of Aspect 1-4, wherein each of the inner barrier and the outer barrier is independently in the form of a bag.

Aspect 6: The system or method of any one of the preceding Aspects, wherein each of the inner barrier and the outer barrier is independently not an ion-exchange membrane.

Aspect 7a: The system or method of any one of the preceding Aspects, wherein the inner barrier is characterized by a ratio of permeability of aqueous ferrous ions to permeability of aqueous protons less than approximately 0.5 (optionally less than or equal to approximately 0.4, optionally less than or equal to approximately 0.3, optionally less than or equal to approximately 0.2, optionally less than or equal to approximately 0.1, optionally less than or equal to approximately 0.09, optionally less than or equal to approximately 0.08, optionally less than or equal to approximately 0.07, optionally less than or equal to approximately 0.06, optionally less than or equal to approximately 0.05, optionally less than or equal to approximately 0.04, optionally less than or equal to approximately 0.03, optionally less than or equal to approximately 0.02, optionally less than or equal to approximately 0.01, optionally less than or equal to approximately 0.005, optionally less than or equal to approximately 0.001, optionally less than or equal to approximately 0.0005, optionally less than or equal to approximately 0.0001).

Aspect 7b: The system or method of any one of the preceding Aspects, wherein the inner barrier is characterized by an H:M permeability ratio (defined elsewhere herein) being at least approximately 5, optionally at least approximately 6, optionally at least approximately 7, optionally at least approximately 8, optionally at least approximately 9, optionally at least approximately 10, optionally at least approximately 11, optionally at least approximately 12, optionally at least approximately 13, optionally at least approximately 14, optionally at least approximately 15, optionally at least approximately 20, optionally at least approximately 25, optionally at least approximately 30, optionally at least approximately 35, optionally at least approximately 40, optionally at least approximately 45, optionally at least approximately 50, optionally at least approximately 55, optionally at least approximately 60, optionally at least approximately 65, optionally at least approximately 70, optionally at least approximately 75, optionally at least approximately 80, optionally at least approximately 85, optionally at least approximately 90, optionally at least approximately 95, optionally at least approximately 100, optionally at least approximately 200, optionally at least approximately 300, optionally at least approximately 400, optionally at least approximately 500, optionally at least approximately 600, optionally at least approximately 700, optionally at least approximately 800, optionally at least approximately 900, optionally at least approximately 1000, optionally selected from the range of greater than or equal to approximately 5 to less than or equal to approximately 1000, optionally selected from the range of greater than or equal to approximately 10 to less than or equal to approximately 1000, wherein any value and range therebetween is explicitly contemplated and disclosed herein, such as optionally selected from the range of greater than or equal to approximately 10 to less than or equal to approximately 1000.

Aspect 7c: The system or method of any one of the preceding Aspects, wherein the inner barrier is characterized by an H:Fe permeability ratio (defined elsewhere herein) being at least approximately 5, optionally at least approximately 6, optionally at least approximately 7, optionally at least approximately 8, optionally at least approximately 9, optionally at least approximately 10, optionally at least approximately 11, optionally at least approximately 12, optionally at least approximately 13, optionally at least approximately 14, optionally at least approximately 15, optionally at least approximately 20, optionally at least approximately 25, optionally at least approximately 30, optionally at least approximately 35, optionally at least approximately 40, optionally at least approximately 45, optionally at least approximately 50, optionally at least approximately 55, optionally at least approximately 60, optionally at least approximately 65, optionally at least approximately 70, optionally at least approximately 75, optionally at least approximately 80, optionally at least approximately 85, optionally at least approximately 90, optionally at least approximately 95, optionally at least approximately 100, optionally at least approximately 200, optionally at least approximately 300, optionally at least approximately 400, optionally at least approximately 500, optionally at least approximately 600, optionally at least approximately 700, optionally at least approximately 800, optionally at least approximately 900, optionally at least approximately 1000, optionally selected from the range of greater than or equal to approximately 5 to less than or equal to approximately 1000, optionally selected from the range of greater than or equal to approximately 10 to less than or equal to approximately 1000, wherein any value and range therebetween is explicitly contemplated and disclosed herein, such as optionally selected from the range of greater than or equal to approximately 10 to less than or equal to approximately 1000.

Aspect 8: The system or method of any one of the preceding Aspects, wherein a flux of aqueous iron ions across the outer barrier is greater than a flux of aqueous iron ions across the first inner barrier.

Aspect 9: The system or method of any one of the preceding Aspects, wherein a flux of liquid across the outer barrier is greater than a flux of aqueous protons across the outer barrier.

Aspect 10: The system or method of any one of the preceding Aspects, wherein the inner barrier is formed of a nanoporous material, a microporous material, or a combination thereof.

Aspect 11: The system or method of any one of the preceding Aspects, wherein the inner barrier is formed of a nonwoven material.

Aspect 12: The system or method of any one of the preceding Aspects, wherein the inner barrier is characterized by a porosity selected from the range of approximately 30% (optionally 32%, optionally 35%, optionally 38%, optionally 40%, optionally 42%, optionally 45%, optionally 48%, optionally 50%) to approximately 80% (optionally 60%, optionally 65%, optionally 75%), wherein any value and range therebetween is explicitly contemplated and disclosed herein.

Aspect 13a: The system or method of any one of the preceding Aspects, wherein the inner barrier is characterized by:

(a) an average pore size selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm; and/or (b) a maximum pore size selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm; and/or (c) an O90 pore size selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm.

Aspect 13b: The system or method of any one of the preceding Aspects, wherein the inner barrier is characterized by an O90 pore size selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm.

Aspect 14: The system or method of any one of the preceding Aspects, wherein the inner barrier is characterized by a thickness selected from the range of approximately 10 μm (optionally approximately 15 μm, optionally approximately 20 μm, optionally approximately 25 μm, optionally approximately 30 μm, optionally approximately 35 μm, optionally approximately 40 μm, optionally approximately 45 μm, optionally approximately 50 μm) to approximately 5 mm (optionally approximately 4.95 mm, optionally approximately 4.90 mm, optionally approximately 4.85 mm, optionally approximately 4.80 mm, optionally approximately 4.70 mm, optionally approximately 4.60 mm, optionally approximately 4.50 mm, optionally approximately 4.40 mm, optionally approximately 4.30 mm, optionally approximately 4.20 mm, optionally approximately 4.10 mm, optionally approximately 4.00 mm, optionally approximately 3.90 mm, optionally approximately 3.80 mm, optionally approximately 3.70 mm, optionally approximately 3.60 mm, optionally approximately 3.50 mm, optionally approximately 3.40 mm, optionally approximately 3.30 mm, optionally approximately 3.20 mm, optionally approximately 3.10 mm, optionally approximately 3.00 mm, optionally approximately 2.90 mm, optionally approximately 2.80 mm, optionally approximately 2.70 mm, optionally approximately 2.60 mm, optionally approximately 2.50 mm, optionally approximately 2.40 mm, optionally approximately 2.30 mm, optionally approximately 2.20 mm, optionally approximately 2.10 mm, optionally approximately 2.00 mm, optionally approximately 1.90 mm, optionally approximately 1.80 mm, optionally approximately 1.70 mm, optionally approximately 1.60 mm, optionally approximately 1.50 mm, optionally approximately 1.40 mm, optionally approximately 1.30 mm, optionally approximately 1.20 mm, optionally approximately 1.10 mm, optionally approximately 1.00 mm, optionally approximately 900 μm, optionally approximately 800 μm, optionally approximately 700 μm, optionally approximately 600 μm, optionally approximately 500 μm), wherein any value and range therebetween is explicitly contemplated and disclosed herein.

Aspect 15: The system or method of any one of the preceding Aspects, wherein the inner barrier is characterized by an electrical resistance selected from the range of approximately 0.1 to approximately 50 $m\Omega cm^2$, wherein any value and range therebetween is explicitly contemplated and disclosed herein.

Aspect 16: The system or method of any one of the preceding Aspects, wherein the inner barrier is characterized by a shutdown temperature greater than 80° C., optionally a shutdown temperature selected from the range of 99° C. to at least 120° C., optionally selected from the range of 100° C. to 300° C., wherein any value and range therebetween is explicitly contemplated and disclosed herein.

Aspect 17: The system or method of any one of the preceding Aspects, wherein the inner barrier is formed of a material comprising a coating on a support material, wherein the coating is characterized by:

(a) an average pore size selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm; and/or (b) a maximum pore size selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm; and/or (c) an O90 pore size selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm.

Aspect 18: The system or method of any one of the preceding Aspects, wherein the inner barrier is characterized by an average pore size, a maximum pore size, and/or an O90 pore size being less than that of the outer barrier, respectively.

Aspect 19: The system or method of any one of the preceding Aspects, wherein the outer barrier is a diaphragm.

Aspect 20: The system or method of any one of the preceding Aspects, wherein the outer barrier is characterized by a thickness selected from the range of range of approximately 100 μm to approximately 5 mm, wherein any value and range therebetween is explicitly contemplated and disclosed herein.

Aspect 21: The system or method of any one of the preceding Aspects, wherein the outer barrier is characterized by an average pore size selected from the range of approximately 0.05 μm to approximately 300 μm, wherein any value and range therebetween is explicitly contemplated and disclosed herein.

Aspect 22: The system or method of any one of the preceding Aspects, wherein each of the inner barrier and the outer barrier (optionally in form of a bag) is independently formed of a material characterized by pore size stability for at least 1000 hours at a pH selected from the range of 2 to 3 and a liquid temperature selected from the range of 60° C. to 80° C.; wherein the pore size stability is defined as the material maintaining an average pore size, a maximum pore size, and/or an O90 pore size within 90% of a characteristic average pore size, a characteristic maximum pore size, and/or a characteristic O90 pore size, respectively. For purposes of this Aspect, the characteristic average pore size of the inner barrier is selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm. For purposes of this Aspect, the characteristic maximum pore size of the inner barrier is selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm. For purposes of this Aspect, the characteristic O90 pore size of the inner barrier is selected from the range of greater than approximately 1 Å (optionally approximately 1 nm, optionally approximately 2 nm, optionally approximately 3 nm, optionally approximately 4 nm, optionally approximately 5 nm, optionally approximately 6 nm, optionally approximately 7 nm, optionally approximately 8 nm, optionally approximately 9 nm, optionally approximately 10 nm, optionally approximately 12 nm, optionally approximately 14 nm, optionally approximately 15 nm, optionally approximately 17 nm, optionally approximately 18 nm, optionally approximately 19 nm, optionally approximately 20 nm, optionally approximately 25 nm, optionally approximately 30 nm, optionally approximately 35 nm, optionally approximately 40 nm, optionally approximately 45 nm, optionally approximately 50 nm, optionally approximately 55 nm, optionally approximately 60 nm, optionally approximately 65 nm, optionally approximately 70 nm, optionally approximately 75 nm, optionally approximately 80 nm, optionally approximately 85 nm, optionally approximately 90 nm, optionally approximately 95 nm, optionally approximately 100 nm) to less than or equal to approximately 1 μm (optionally approximately 0.99 μm, optionally approximately 0.98 μm, optionally approximately 0.97 μm, optionally approximately 0.96 μm, optionally approximately 0.95 μm, optionally approximately 0.94 μm, optionally approximately 0.93 μm, optionally approximately 0.92 μm, optionally approximately 0.91 μm, optionally approximately 0.90 μm, optionally approximately 0.88 μm, optionally approximately 0.85 μm, optionally approximately 0.82 μm, optionally approximately 0.80 μm, optionally approximately 0.75 μm, optionally approximately 0.70 μm, optionally approximately 0.65 μm, optionally approximately 0.60 μm, optionally approximately 0.55 μm, optionally approximately 0.50 μm, optionally approximately 0.45 μm, optionally approximately 0.40 μm, optionally approximately 0.35 μm, optionally approximately 0.30 μm, optionally approximately 0.25 μm, optionally approximately 0.20 μm, optionally approximately 0.19 μm, optionally approximately 0.18 μm, optionally approximately 0.16 μm, optionally approximately 0.15 μm, optionally approximately 0.14 μm, optionally approximately 0.12 μm, optionally approximately 0.11 μm), wherein any value and range therebetween is explicitly contemplated and disclosed herein, such as approximately 0.1 nm to approximately 500 nm, approximately 0.1 nm to approximately 200 nm, approximately 0.1 nm to approximately 100 nm, approximately 0.1 nm to approximately 50 nm, approximately 0.1 nm to approximately 20 nm, approximately 0.1 nm to approximately 10 nm, approximately 0.1 nm to approximately 5 nm, and approximately 0.1 nm to approximately 1 nm.

Aspect 23: The system or method of any one of the preceding Aspects, wherein the inner barrier surrounds at least a majority of the anode and/or wherein the inner barrier surrounds all electrolyte-facing surfaces of the anode and/or wherein the inner barrier (optionally in the form of a bag) surrounds all electrolyte-exposed portions of the anode's surface.

Aspect 24: The system or method of any one of the preceding Aspects, wherein the inner barrier surrounds all sides except the top surface of the anode.

Aspect 25: The system or method of any one of the preceding Aspects, wherein the outer barrier surrounds at least a majority of the inner barrier and/or wherein the outer barrier surrounds all electrolyte-facing surfaces of the inner barrier and/or wherein the outer barrier surrounds all electrolyte-exposed portions of the inner barrier's surface.

Aspect 26: The system or method of any one of Aspects 1 or 3-25 comprising a removable anode-assembly, the removable anode-assembly comprising: the anode, the mid-region, the inner barrier, the anolyte region, and the outer barrier; and wherein the anode, the inner barrier, and the outer barrier are all suspended from a hanger bar.

Aspect 27: The system or method of any one of Aspects 2 or 26, wherein the anode assembly is removable and insertable monolithically into the plating bath by moving the hanger bar.

Aspect 28: The system or method of Aspect 26 or 27, wherein the anode-assembly is at least partially immersed in the plating bath and supported by the hanger bar.

Aspect 29: The system or method of any one of Aspects 1, 2, or 4-28, wherein the cell comprises a net flow of water from the midlyte to the anolyte during operation.

Aspect 30a: The system or method of Aspect 29, wherein a total dissolved ion concentration in the anolyte is greater than that in the midlyte. Aspect 30b: The system or method of Aspect 29, wherein a steady state total dissolved ion concentration in the anolyte is greater than that in the midlyte.

Aspect 31: The system or method of Aspect 29 or 30, wherein an osmotic pressure is present between the anolyte and the midlyte such that water is osmotically provided to the anolyte from the midlyte through the first inner separator.

Aspect 32: The system or method of any one of the preceding Aspects, wherein the midlyte is withdrawn during operation of the cell.

Aspect 33a: The system or method of any one of the preceding Aspects, wherein the midlyte has a pH selected from the range of range of approximately −0.5 (optionally approximately −0.4, optionally approximately −0.3, optionally approximately −0.2, optionally approximately −0.1, optionally approximately −0.05, optionally approximately −0.1, optionally 0, optionally approximately 0.1, optionally approximately 0.12, optionally approximately 0.13, optionally approximately 0.14, optionally approximately 0.15, optionally approximately 0.16, optionally approximately 0.17, optionally approximately 0.18, optionally approximately 0.19, optionally approximately 0.2, optionally approximately 0.22, optionally approximately 0.25, optionally approximately 0.28, optionally approximately 0.3, optionally approximately 0.4, optionally approximately 0.5, optionally approximately 0.6, optionally approximately 0.7, optionally approximately 0.8, optionally approximately 0.9) to approximately 3 (optionally approximately 2.9, optionally approximately 2.8, optionally approximately 2.7, optionally approximately 2.6, optionally approximately 2.5, optionally approximately 2.4, optionally approximately 2.3, optionally approximately 2.2, optionally approximately 2.1, optionally approximately 2.0, optionally approximately 1.9, optionally approximately 1.8, optionally approximately 1.7, optionally approximately 1.6, optionally approximately 1.5, optionally approximately 1.4, optionally approximately 1.3, optionally approximately 1.2, optionally approximately 1.1, optionally approximately 1.0, optionally approximately 0.9, optionally approximately 0.8, optionally approximately 0.7, optionally approximately 0.6, optionally approximately 0.5, optionally approximately 0.45, optionally approximately 0.4), wherein any value and range therebetween is explicitly contemplated and disclosed herein.

Aspect 33b: The system or method of any one of the preceding Aspects, wherein, during steady state operation of the cell, the midlyte has a steady state pH selected from the range of range of approximately −0.5 (optionally approximately −0.4, optionally approximately −0.3, optionally approximately −0.2, optionally approximately −0.1, optionally approximately −0.05, optionally approximately −0.1, optionally 0, optionally approximately 0.1, optionally approximately 0.12, optionally approximately 0.13, optionally approximately 0.14, optionally approximately 0.15, optionally approximately 0.16, optionally approximately 0.17, optionally approximately 0.18, optionally approximately 0.19, optionally approximately 0.2, optionally approximately 0.22, optionally approximately 0.25, optionally approximately 0.28, optionally approximately 0.3, optionally approximately 0.4, optionally approximately 0.5, optionally approximately 0.6, optionally approximately 0.7, optionally approximately 0.8, optionally approximately 0.9) to approximately 3 (optionally approximately 2.9, optionally approximately 2.8, optionally approximately 2.7, optionally approximately 2.6, optionally approximately 2.5, optionally approximately 2.4, optionally approximately 2.3, optionally approximately 2.2, optionally approximately 2.1, optionally approximately 2.0, optionally approximately 1.9, optionally approximately 1.8, optionally approximately 1.7, optionally approximately 1.6, optionally approximately 1.5, optionally approximately 1.4, optionally approximately 1.3, optionally approximately 1.2, optionally approximately 1.1, optionally approximately 1.0, optionally approximately 0.9, optionally approximately 0.8, optionally approximately 0.7, optionally approximately 0.6, optionally approximately 0.5, optionally approximately 0.45, optionally approximately 0.4), wherein any value and range therebetween is explicitly contemplated and disclosed herein.

Aspect 34a: The system or method of any one of the preceding Aspects, wherein the midlyte has a ferric ion concentration selected from the range of approximately 0.001 M (optionally approximately 0.002 M, optionally approximately 0.003 M, optionally approximately 0.004 M, optionally approximately 0.005 M, optionally approximately 0.006 M, optionally approximately 0.007 M, optionally approximately 0.008 M, optionally approximately 0.009 M, optionally approximately 0.01 M) to approximately 0.5 M (optionally approximately 0.45 M, optionally approximately 0.40 M, optionally approximately 0.35 M, optionally approximately 0.30 M, optionally approximately 0.25 M, optionally approximately 0.24 M, optionally approximately 0.23 M, optionally approximately 0.22 M, optionally approximately 0.21 M, optionally approximately 0.20 M, optionally approximately 0.19 M, optionally approximately 0.18 M, optionally approximately 0.17 M, optionally approximately 0.16 M, optionally approximately 0.15 M, optionally approximately 0.14 M, optionally approximately 0.13 M, optionally approximately 0.12 M, optionally approximately 0.11 M, optionally approximately 0.10 M, optionally approximately 0.09 M, optionally approximately 0.08 M, optionally approximately 0.07 M, optionally approximately 0.06 M, optionally approximately 0.05 M), wherein any value and range therebetween is explicitly contemplated and disclosed herein. Aspect 34b: The system or method of any one of the preceding Aspects, wherein, during steady state operation of the cell, the midlyte has a steady state ferric ion concentration selected from the range of approximately 0.001 M (optionally approximately 0.002 M, optionally approximately 0.003 M, optionally approximately 0.004 M, optionally approximately 0.005 M, optionally approximately 0.006 M, optionally approximately 0.007 M, optionally approximately 0.008 M, optionally approximately 0.009 M, optionally approximately 0.01 M) to approximately 0.5 M (optionally approximately 0.45 M, optionally approximately 0.40 M, optionally approximately 0.35 M, optionally approximately 0.30 M, optionally approximately 0.25 M, optionally approximately 0.24 M, optionally approximately 0.23 M, optionally approximately 0.22 M, optionally approximately 0.21 M, optionally approximately 0.20 M, optionally approximately 0.19 M, optionally approximately 0.18 M, optionally approximately 0.17 M, optionally approximately 0.16 M, optionally approximately 0.15 M, optionally approximately 0.14 M, optionally approximately 0.13 M, optionally approximately 0.12 M, optionally approximately 0.11 M, optionally approximately 0.10 M, optionally approximately 0.09 M, optionally approximately 0.08 M, optionally approximately 0.07 M, optionally approximately 0.06 M, optionally approximately 0.05 M), wherein any value and range therebetween is explicitly contemplated and disclosed herein.

Aspect 35a: The system or method of any one of the preceding Aspects, wherein the anolyte has a ferric ion concentration selected from the range of approximately 0.001 M (optionally approximately 0.002 M, optionally approximately 0.003 M, optionally approximately 0.004 M, optionally approximately 0.005 M, optionally approximately 0.006 M, optionally approximately 0.007 M, optionally approximately 0.008 M, optionally approximately 0.009 M, optionally approximately 0.01 M) to 1.5 M (optionally approximately 1.4 M, optionally approximately 1.3 M, optionally approximately 1.2 M, optionally approximately 1.1 M, optionally approximately 1.0 M, optionally approximately 0.90 M, optionally approximately 0.80 M, optionally approximately 0.70 M, optionally approximately 0.60 M, optionally approximately 0.50 M, optionally approximately 0.45 M, optionally approximately 0.40 M, optionally approximately 0.35 M, optionally approximately 0.30 M, optionally approximately 0.25 M, optionally approximately 0.24 M, optionally approximately 0.23 M, optionally approximately 0.22 M, optionally approximately 0.21 M, optionally approximately 0.20 M, optionally approximately 0.19 M, optionally approximately 0.18 M, optionally approximately 0.17 M, optionally approximately 0.16 M, optionally approximately 0.15 M, optionally approximately 0.14 M, optionally approximately 0.13 M, optionally approximately 0.12 M, optionally approximately 0.11 M, optionally approximately 0.10 M, optionally approximately 0.09 M, optionally approximately 0.08 M, optionally approximately 0.07 M, optionally approximately 0.06 M, optionally approximately 0.05 M), wherein any value and range therebetween is explicitly contemplated and disclosed herein. Aspect 35b: The system or method of any one of the preceding Aspects, wherein, during steady state operations of the cell, the anolyte has a steady state ferric ion concentration selected from the range of approximately 0.001 M (optionally approximately 0.002 M, optionally approximately 0.003 M, optionally approximately 0.004 M, optionally approximately 0.005 M, optionally approximately 0.006 M, optionally approximately 0.007 M, optionally approximately 0.008 M, optionally approximately 0.009 M, optionally approximately 0.01 M) to 1.5 M (optionally approximately 1.4 M, optionally approximately 1.3 M, optionally approximately 1.2 M, optionally approximately 1.1 M, optionally approximately 1.0 M, optionally approximately 0.90 M, optionally approximately 0.80 M, optionally approximately 0.70 M, optionally approximately 0.60 M, optionally approximately 0.50 M, optionally approximately 0.45 M, optionally approximately 0.40 M, optionally approximately 0.35 M, optionally approximately 0.30 M, optionally approximately 0.25 M, optionally approximately 0.24 M, optionally approximately 0.23 M, optionally approximately 0.22 M, optionally approximately 0.21 M, optionally approximately 0.20 M, optionally approximately 0.19 M, optionally approximately 0.18 M, optionally approximately 0.17 M, optionally approximately 0.16 M, optionally approximately 0.15 M, optionally approximately 0.14 M, optionally approximately 0.13 M, optionally approximately 0.12 M, optionally approximately 0.11 M, optionally approximately 0.10 M, optionally approximately 0.09 M, optionally approximately 0.08 M, optionally approximately 0.07 M, optionally approximately 0.06 M, optionally approximately 0.05 M), wherein any value and range therebetween is explicitly contemplated and disclosed herein.

Aspect 36a: The system or method of any one of the preceding Aspects, wherein the anolyte has a total iron ion concentration selected from the range of approximately 0.001 M (optionally approximately 0.002 M, optionally approximately 0.003 M, optionally approximately 0.004 M, optionally approximately 0.005 M, optionally approximately 0.006 M, optionally approximately 0.007 M, optionally approximately 0.008 M, optionally approximately 0.009 M, optionally approximately 0.01 M) to 1.5 M (optionally approximately 1.4 M, optionally approximately 1.3 M, optionally approximately 1.2 M, optionally approximately 1.1 M, optionally approximately 1.0 M, optionally approximately 0.90 M, optionally approximately 0.80 M, optionally approximately 0.70 M, optionally approximately 0.60 M, optionally approximately 0.50 M, optionally approximately 0.45 M, optionally approximately 0.40 M, optionally approximately 0.35 M, optionally approximately 0.30 M, optionally approximately 0.25 M, optionally approximately 0.24 M, optionally approximately 0.23 M, optionally approximately 0.22 M, optionally approximately 0.21 M, optionally approximately 0.20 M, optionally approximately 0.19 M, optionally approximately 0.18 M, optionally approximately 0.17 M, optionally approximately 0.16 M, optionally approximately 0.15 M, optionally approximately 0.14 M, optionally approximately 0.13 M, optionally approximately 0.12 M, optionally approximately 0.11 M, optionally approximately 0.10 M, optionally approximately 0.09 M, optionally approximately 0.08 M, optionally approximately 0.07 M, optionally approximately 0.06 M, optionally approximately 0.05 M), wherein any value and range therebetween is explicitly contemplated and disclosed herein. Aspect 36b: The system or method of any one of the preceding Aspects, wherein, during steady state operations of the cell, the anolyte has a steady state iron ion concentration selected from the range of approximately 0.001 M (optionally approximately 0.002 M, optionally approximately 0.003 M, optionally approximately 0.004 M, optionally approximately 0.005 M, optionally approximately 0.006 M, optionally approximately 0.007 M, optionally approximately 0.008 M, optionally approximately 0.009 M, optionally approximately 0.01 M) to 1.5 M (optionally approximately 1.4 M, optionally approximately 1.3 M, optionally approximately 1.2 M, optionally approximately 1.1 M, optionally approximately 1.0 M, optionally approximately 0.90 M, optionally approximately 0.80 M, optionally approximately 0.70 M, optionally approximately 0.60 M, optionally approximately 0.50 M, optionally approximately 0.45 M, optionally approximately 0.40 M, optionally approximately 0.35 M, optionally approximately 0.30 M, optionally approximately 0.25 M, optionally approximately 0.24 M, optionally approximately 0.23 M, optionally approximately 0.22 M, optionally approximately 0.21 M, optionally approximately 0.20 M, optionally approximately 0.19 M, optionally approximately 0.18 M, optionally approximately 0.17 M, optionally approximately 0.16 M, optionally approximately 0.15 M, optionally approximately 0.14 M, optionally approximately 0.13 M, optionally approximately 0.12 M, optionally approximately 0.11 M, optionally approximately 0.10 M, optionally approximately 0.09 M, optionally approximately 0.08 M, optionally approximately 0.07 M, optionally approximately 0.06 M, optionally approximately 0.05 M), wherein any value and range therebetween is explicitly contemplated and disclosed herein.

Aspect 37a: The system or method of any one of the preceding Aspects, wherein the anolyte has a pH selected from the range of range of approximately −0.5 (optionally approximately −0.4, optionally approximately −0.3, optionally approximately −0.2, optionally approximately −0.1, optionally approximately −0.05, optionally approximately −0.1, optionally 0, optionally approximately 0.1, optionally approximately 0.12, optionally approximately 0.13, optionally approximately 0.14, optionally approximately 0.15, optionally approximately 0.16, optionally approximately 0.17, optionally approximately 0.18, optionally approximately 0.19, optionally approximately 0.2, optionally approximately 0.22, optionally approximately 0.25, optionally approximately 0.28, optionally approximately 0.3, optionally approximately 0.4, optionally approximately 0.5, optionally approximately 0.6, optionally approximately 0.7, optionally approximately 0.8, optionally approximately 0.9) to approximately 2 (optionally approximately 1.9, optionally approximately 1.8, optionally approximately 1.7, optionally approximately 1.6, optionally approximately 1.5, optionally approximately 1.4, optionally approximately 1.3, optionally approximately 1.2, optionally approximately 1.1, optionally approximately 1.0, optionally approximately 0.9, optionally approximately 0.8, optionally approximately 0.7, optionally approximately 0.6, optionally approximately 0.5, optionally approximately 0.4, optionally approximately 0.3, optionally approximately 0.2, optionally approximately 0.1), wherein any value and range therebetween is explicitly contemplated and disclosed herein. Aspect 37b: The system or method of any one of the preceding Aspects, wherein the anolyte has a steady state pH selected from the range of range of approximately −0.5 (optionally approximately −0.4, optionally approximately −0.3, optionally approximately −0.2, optionally approximately −0.1, optionally approximately −0.05, optionally approximately −0.1, optionally 0, optionally approximately 0.1, optionally approximately 0.12, optionally approximately 0.13, optionally approximately 0.14, optionally approximately 0.15, optionally approximately 0.16, optionally approximately 0.17, optionally approximately 0.18, optionally approximately 0.19, optionally approximately 0.2, optionally approximately 0.22, optionally approximately 0.25, optionally approximately 0.28, optionally approximately 0.3, optionally approximately 0.4, optionally approximately 0.5, optionally approximately 0.6, optionally approximately 0.7, optionally approximately 0.8, optionally approximately 0.9) to approximately 2 (optionally approximately 1.9, optionally approximately 1.8, optionally approximately 1.7, optionally approximately 1.6, optionally approximately 1.5, optionally approximately 1.4, optionally approximately 1.3, optionally approximately 1.2, optionally approximately 1.1, optionally approximately 1.0, optionally approximately 0.9, optionally approximately 0.8, optionally approximately 0.7, optionally approximately 0.6, optionally approximately 0.5, optionally approximately 0.4, optionally approximately 0.3, optionally approximately 0.2, optionally approximately 0.1), wherein any value and range therebetween is explicitly contemplated and disclosed herein.

Aspect 38a: The system or method of any one of the preceding Aspects, wherein the catholyte has a ferric ion concentration selected from the range of approximately 0.001 M (optionally approximately 0.002 M, optionally approximately 0.003 M, optionally approximately 0.004 M, optionally approximately 0.005 M, optionally approximately 0.006 M, optionally approximately 0.007 M, optionally approximately 0.008 M, optionally approximately 0.009 M, optionally approximately 0.01 M) to approximately 0.5 M (optionally approximately 0.45 M, optionally approximately 0.40 M, optionally approximately 0.35 M, optionally approximately 0.30 M, optionally approximately 0.25 M, optionally approximately 0.24 M, optionally approximately 0.23 M, optionally approximately 0.22 M, optionally approximately 0.21 M, optionally approximately 0.20 M, optionally approximately 0.19 M, optionally approximately 0.18 M, optionally approximately 0.17 M, optionally approximately 0.16 M, optionally approximately 0.15 M, optionally approximately 0.14 M, optionally approximately 0.13 M, optionally approximately 0.12 M, optionally approximately 0.11 M, optionally approximately 0.10 M, optionally approximately 0.09 M, optionally approximately 0.08 M, optionally approximately 0.07 M, optionally approximately 0.06 M, optionally approximately 0.05 M, optionally approximately 0.04 M, optionally approximately 0.03 M, optionally approximately 0.02 M), wherein any value and range therebetween is explicitly contemplated and disclosed herein. Aspect 38b: The system or method of any one of the preceding Aspects, wherein the catholyte has a steady state ferric ion concentration selected from the range of approximately 0.001 M (optionally approximately 0.002 M, optionally approximately 0.003 M, optionally approximately 0.004 M, optionally approximately 0.005 M, optionally approximately 0.006 M, optionally approximately 0.007 M, optionally approximately 0.008 M, optionally approximately 0.009 M, optionally approximately 0.01 M) to approximately 0.5 M (optionally approximately 0.45 M, optionally approximately 0.40 M, optionally approximately 0.35 M, optionally approximately 0.30 M, optionally approximately 0.25 M, optionally approximately 0.24 M, optionally approximately 0.23 M, optionally approximately 0.22 M, optionally approximately 0.21 M, optionally approximately 0.20 M, optionally approximately 0.19 M, optionally approximately 0.18 M, optionally approximately 0.17 M, optionally approximately 0.16 M, optionally approximately 0.15 M, optionally approximately 0.14 M, optionally approximately 0.13 M, optionally approximately 0.12 M, optionally approximately 0.11 M, optionally approximately 0.10 M, optionally approximately 0.09 M, optionally approximately 0.08 M, optionally approximately 0.07 M, optionally approximately 0.06 M, optionally approximately 0.05 M, optionally approximately 0.04 M, optionally approximately 0.03 M, optionally approximately 0.02 M), wherein any value and range therebetween is explicitly contemplated and disclosed herein.

Aspect 39a: The system or method of any one of the preceding Aspects, wherein the catholyte has a ferrous ion concentration selected from the range of approximately 0.5 M (optionally approximately 1.0 M) to approximately 3 M (optionally approximately 2.5 M, optionally approximately 2.0 M), wherein any value and range therebetween is explicitly contemplated and disclosed herein. Aspect 39b: The system or method of any one of the preceding Aspects, wherein the catholyte has a steady state ferrous ion concentration selected from the range of approximately 0.5 M (optionally approximately 1.0 M) to approximately 3 M (optionally approximately 2.5 M, optionally approximately 2.0 M), wherein any value and range therebetween is explicitly contemplated and disclosed herein.

Aspect 40a: The system or method of any one of the preceding Aspects, wherein the catholyte has a pH selected from the range of approximately 1 (optionally approximately 1.1, optionally approximately 1.2, optionally approximately 1.3, optionally approximately 1.4, optionally approximately 1.5, optionally approximately 1.6, optionally approximately 1.7, optionally approximately 1.8, optionally approximately 1.9, optionally approximately 2.0) to approximately 5 (optionally approximately 4.5, optionally approximately 4.0, optionally approximately 3.5, optionally approximately 3.1, optionally approximately 3.0, optionally approximately 2.9, optionally approximately 2.8, optionally approximately 2.7, optionally approximately 2.6, optionally approximately 2.5, optionally approximately 2.4, optionally approximately 2.3, optionally approximately 2.2, optionally approximately 2.1, optionally approximately 2.0), wherein any value and range therebetween is explicitly contemplated and disclosed herein. Aspect 40b: The system or method of any one of the preceding Aspects, wherein the catholyte has a steady state pH selected from the range of approximately 1 (optionally approximately 1.1, optionally approximately 1.2, optionally approximately 1.3, optionally approximately 1.4, optionally approximately 1.5, optionally approximately 1.6, optionally approximately 1.7, optionally approximately 1.8, optionally approximately 1.9, optionally approximately 2.0) to approximately 5 (optionally approximately 4.5, optionally approximately 4.0, optionally approximately 3.5, optionally approximately 3.1, optionally approximately 3.0, optionally approximately 2.9, optionally approximately 2.8, optionally approximately 2.7, optionally approximately 2.6, optionally approximately 2.5, optionally approximately 2.4, optionally approximately 2.3, optionally approximately 2.2, optionally approximately 2.1, optionally approximately 2.0), wherein any value and range therebetween is explicitly contemplated and disclosed herein. Aspect 40c: The system or method of any one of the preceding Aspects, wherein the catholyte has a pH selected from the range of approximately 1 (optionally approximately 1.1, optionally approximately 1.2, optionally approximately 1.3, optionally approximately 1.4, optionally approximately 1.5, optionally approximately 1.6, optionally approximately 1.7, optionally approximately 1.8, optionally approximately 1.9, optionally approximately 2.0) to approximately 7 (optionally approximately 6.5, optionally approximately 6.0, optionally approximately 5.5, optionally approximately 5.0, optionally approximately 4.5, optionally approximately 4.0, optionally approximately 3.5, optionally approximately 3.1, optionally approximately 3.0, optionally approximately 2.9, optionally approximately 2.8, optionally approximately 2.7, optionally approximately 2.6, optionally approximately 2.5, optionally approximately 2.4, optionally approximately 2.3, optionally approximately 2.2, optionally approximately 2.1, optionally approximately 2.0), wherein any value and range therebetween is explicitly contemplated and disclosed herein. Aspect 40b: The system or method of any one of the preceding Aspects, wherein the catholyte has a steady state pH selected from the range of approximately 1 (optionally approximately 1.1, optionally approximately 1.2, optionally approximately 1.3, optionally approximately 1.4, optionally approximately 1.5, optionally approximately 1.6, optionally approximately 1.7, optionally approximately 1.8, optionally approximately 1.9, optionally approximately 2.0) to approximately 7 (optionally approximately 6.5, optionally approximately 6.0, optionally approximately 5.5, optionally approximately 5.0, optionally approximately 4.5, optionally approximately 4.0, optionally approximately 3.5, optionally approximately 3.1, optionally approximately 3.0, optionally approximately 2.9, optionally approximately 2.8, optionally approximately 2.7, optionally approximately 2.6, optionally approximately 2.5, optionally approximately 2.4, optionally approximately 2.3, optionally approximately 2.2, optionally approximately 2.1, optionally approximately 2.0), wherein any value and range therebetween is explicitly contemplated and disclosed herein.

Aspect 41a: The system or method of any one of the preceding Aspects, wherein a liquid level of the catholyte is greater than a liquid level of the midlyte. Aspect 41b: The system or method of any one of the preceding Aspects, wherein a liquid level of the catholyte is greater than a liquid level of the midlyte by approximately 5 mm to approximately 150 mm, wherein any value and range therebetween is explicitly contemplated and disclosed herein.

Aspect 42: The system or method of any one of the preceding Aspects, wherein the cell comprises a catholyte-inlet to provide a ferrous-rich aqueous acidic solution to the catholyte.

Aspect 43: The system or method of any one of the preceding Aspects, wherein each of the catholyte, anolyte, and the midlyte comprise sulfuric acid.

Aspect 44a: The system or method of any one of the preceding Aspects, wherein each of the catholyte, anolyte, and the midlyte comprise a molar ratio of hydrochloric acid to sulfuric acid selected from the range of 0 to approximately 0.01, wherein any value and range therebetween is explicitly contemplated and disclosed herein. Aspect 44b: The system or method of any one of the preceding Aspects, wherein each of the catholyte, anolyte, and the midlyte is free of hydrochloric acid.

Aspect 45: The system or method of any one of the preceding Aspects, wherein the outer barrier is at least partially immersed in the plating bath.

Aspect 46: The system or method of any one of the preceding Aspects, wherein the cathode is at least partially immersed in the plating bath.

Aspect 47: The system or method of any one of the preceding Aspects comprising an ore leach subsystem configured to leach an iron ore and produce a first ferrous-rich aqueous acidic solution, wherein the system is configured to withdrawn the midlyte and provide the withdrawn midlyte to the ore leach subsystem.

Aspect 48: The system or method of any one of the preceding Aspects comprising an impurity removal subsystem configured to remove at least a portion of impurities from the first ferrous-rich aqueous acidic solution to produce a treated ferrous-rich aqueous acidic solution; wherein the plating bath is replenished with the treated ferrous-rich aqueous acidic solution.

Aspect 49: The system or method of Aspect 48, wherein the removed impurities comprise aluminum salt(s), chromium salt(s), phosphorous salt(s), magnesium salt(s), and/or manganese salt(s).

Aspect 50: The system or method of any one of Aspects 1-3 or 5-49 comprising a first spacer between the outer barrier and the inner barrier and defining the width of the mid-region.

Aspect 51: The system or method of Aspect 50, wherein the first spacer maintains the width (or approximately with up to 20% width variation) of the mid-region throughout said mid-region.

Aspect 52: The system or method of Aspect 50 or 51, wherein the first spacer is a part of the inner barrier.

Aspect 53: The system or method of Aspect 50 or 51, wherein the first spacer is a frame.

Aspect 54: The system or method of any one of Aspects 50-53, wherein the first spacer is in physical contact with the inner barrier and the outer barrier.

Aspect 55: The system or method of any one of Aspects 50-54 wherein the cell comprises a second spacer between the inner barrier and the anode.

Aspect 56: The system or method of Aspect 55, wherein the second spacer is a part of the first inner separator.

Aspect 57: The system or method of Aspect 55 or 56, wherein the second spacer is in physical contact with the inner barrier and the outer barrier.

Aspect 58: The system or method of Aspect 55, 56, or 57, wherein the second spacer is a frame.

Aspect 59: The system or method of any one of the preceding Aspects, wherein the anode is a lead anode.

Aspect 60a: The system or method of any one of the preceding Aspects, wherein the iron electrowinning cell is characterized by an iron electrowinning Faradaic efficiency at the cathode selected from the range of approximately 85% to approximately 99.99%, wherein any value and range therebetween is explicitly contemplated and disclosed herein. Aspect 60b: The system or method of any one of the preceding Aspects, wherein the iron electrowinning cell is characterized by a steady state iron electrowinning Faradaic efficiency at the cathode selected from the range of approximately 85% to approximately 99.99%, wherein any value and range therebetween is explicitly contemplated and disclosed herein.

Aspect 61a: The system or method of any one of the preceding Aspects, wherein the iron electrowinning cell is characterized by an oxygen evolution reaction (OER) selectivity at the anode selected from the range of approximately 80% to approximately 99.99%, wherein any value and range therebetween is explicitly contemplated and disclosed herein. Aspect 61 b: The system or method of any one of the preceding Aspects, wherein the iron electrowinning cell is characterized by a steady state oxygen evolution reaction (OER) selectivity at the anode selected from the range of approximately 80% to approximately 99.99%, wherein any value and range therebetween is explicitly contemplated and disclosed herein.

Aspect 62a: The system or method of any one of the preceding Aspects, wherein each of the midlyte, catholyte, and anolyte has a temperature selected from the range of approximately 50° C. (optionally approximately 52° C., optionally approximately 55° C., optionally approximately 58° C.) to approximately 90° C. (optionally approximately 85° C., optionally approximately 82° C., optionally approximately 80° C., optionally approximately 78° C., optionally approximately 75° C., optionally approximately 72° C., optionally approximately 70° C., optionally approximately 68° C., optionally approximately 65° C.), wherein any value and range therebetween is explicitly contemplated and disclosed herein, such as approximately 58° C. to approximately 82° C. Aspect 62b: The system or method of any one of the preceding Aspects, wherein each of the midlyte, catholyte, and anolyte has a steady state temperature selected from the range of approximately 50° C. (optionally approximately 52° C., optionally approximately 55° C., optionally approximately 58° C.) to approximately 90° C. (optionally approximately 85° C., optionally approximately 82° C., optionally approximately 80° C., optionally approximately 78° C., optionally approximately 75° C., optionally approximately 72° C., optionally approximately 70° C., optionally approximately 68° C., optionally approximately 65° C.), wherein any value and range therebetween is explicitly contemplated and disclosed herein, such as approximately 58° C. to approximately 82° C.

Aspect 63: The system or method of any one of the preceding Aspects, wherein the cell comprises a passive spillway defining a maximum anolyte liquid level and configured to allow excess anolyte to spill into the midlyte.

Aspect 64: The system or method of any one of the preceding Aspects, wherein a liquid level of the midlyte is equal to or less than that of the anolyte.

Aspect 65: The system of any one of the preceding Aspects, wherein each of the inner barrier and the outer barrier is porous.

Aspect 66: The system or method of Aspect 1, wherein each of the inner barrier bag and the outer barrier bag is porous.

Aspect 67: A method of making electrolytic iron in an iron electrowinning system comprising:

a three-chamber iron electrowinning cell comprising:

a plating bath containing a catholyte having dissolved iron ions therein;

a cathode in contact with the catholyte;

an anode in contact with an anolyte;

an outer barrier in the form of a bag ("outer barrier bag") at least partially surrounding the anode and defining an anolyte-region containing the anolyte in contact with the anode; and an inner barrier in the form of a bag ("inner barrier bag") at least partially surrounding the inner barrier bag and defining a midlyte region containing a midlyte between the inner barrier bag and the outer barrier bag;

the method comprising:

maintaining a pressure difference between the catholyte and the midlyte across the outer porous barrier sufficient to cause catholyte to flow through the outer porous barrier into the midlyte region;

removing a portion of midlyte from the midlyte region;

electrodepositing iron metal on the cathode; and electrochemically oxidizing water and evolving oxygen at the anode.

Aspect 68: A method of making electrolytic iron in an iron electrowinning system comprising:

a three-chamber iron electrowinning cell comprising:

a plating bath containing a catholyte having dissolved iron ions therein;

a cathode in contact with the catholyte; and a removable anode-assembly comprising:

an anode in contact with an anolyte;

an inner barrier defining an anolyte-region between the inner barrier and the anode, the anolyte-region containing an anolyte in contact with the anode; and an outer barrier defining a mid-region between the outer barrier and the inner barrier, the mid-region containing a midlyte, the midlyte being separated from the anolyte by the inner barrier and separated from the catholyte by the outer barrier;

the method comprising:

maintaining a pressure difference between the catholyte and the midlyte across the outer porous barrier sufficient to cause catholyte to flow through the outer porous barrier into the midlyte region;

removing a portion of midlyte from the midlyte region;

electrodepositing iron metal on the cathode; and electrochemically oxidizing water and evolving oxygen at the anode.

Aspect 69: A method of making electrolytic iron in an iron electrowinning system comprising:

a three-chamber iron electrowinning cell comprising:

a plating bath containing a catholyte having dissolved iron ions therein;

a cathode in contact with the catholyte;

an anode in contact with an anolyte;

an inner barrier defining an anolyte-region between the inner barrier and the anode, the anolyte-region containing an anolyte in contact with the anode; and an outer barrier defining a mid-region between the outer barrier and the inner barrier, the mid-region containing a midlyte, the midlyte being separated from the anolyte by the inner barrier and separated from the catholyte by the outer barrier;

the method comprising:

maintaining a pressure difference between the catholyte and the midlyte across the outer porous barrier sufficient to cause catholyte to flow through the outer porous barrier into the midlyte region;

removing a portion of midlyte from the midlyte region;

establishing a net flow of water from the mid-region to the anolyte region across the inner barrier;

electrodepositing iron metal on the cathode; and electrochemically oxidizing water and evolving oxygen at the anode.

Aspect 70: The method of Aspect 69 comprising maintaining a net flow of water from the mid-region to the anolyte region across the inner barrier.

Aspect 71: The method of Aspect 69 or 70 comprising transferring water from the mid-region to the anolyte region across the inner barrier at a rate sufficient to replace water consumed and/or lost from the anolyte.

Aspect 72: A method of making electrolytic iron in an iron electrowinning system comprising:

a three-chamber iron electrowinning cell comprising:

a plating bath containing a catholyte having dissolved iron ions therein;

a cathode in contact with the catholyte;

an anode in contact with an anolyte;

an inner barrier defining an anolyte-region between the inner barrier and the anode, the anolyte-region containing an anolyte in contact with the anode;

an outer barrier defining a mid-region between the outer barrier and the inner barrier, the mid-region containing a midlyte, the midlyte being separated from the anolyte by the inner barrier and separated from the catholyte by the outer barrier; and a first spacer between the outer barrier and the inner barrier and defining the width of the mid-region;

the method comprising:

maintaining a pressure difference between the catholyte and the midlyte across the outer porous barrier sufficient to cause catholyte to flow through the outer porous barrier into the midlyte region;

removing a portion of midlyte from the midlyte region;

electrodepositing iron metal on the cathode; and electrochemically oxidizing water and evolving oxygen at the anode.

Aspect 73: The system or method of any one of the preceding Aspects, wherein the outer barrier is characterized by a bulk liquid permeability that is greater than the bulk liquid permeability of the inner barrier(s) by a factor of at least approximately 5, optionally at least approximately 6, optionally at least approximately 7, optionally at least approximately 8, optionally at least approximately 9, optionally at least approximately 10, optionally at least approximately 11, optionally at least approximately 12, optionally at least approximately 13, optionally at least approximately 14, optionally at least approximately 15, optionally at least approximately 20, optionally at least approximately 25, optionally at least approximately 30, optionally at least approximately 35, optionally at least approximately 40, optionally at least approximately 45, optionally at least approximately 50, optionally at least approximately 55, optionally at least approximately 60, optionally at least approximately 65, optionally at least approximately 70, optionally at least approximately 75, optionally at least approximately 80, optionally at least approximately 85, optionally at least approximately 90, optionally at least approximately 95, optionally at least approximately 100, optionally at least approximately 200, optionally at least approximately 300, optionally at least approximately 400, optionally at least approximately 500, optionally at least approximately 600, optionally at least approximately 700, optionally at least approximately 800, optionally at least approximately 900, optionally at least approximately 1000, optionally selected from the range of greater than or equal to approximately 5 to less than or equal to approximately 1000, optionally selected from the range of greater than or equal to approximately 10 to less than or equal to approximately 1000, wherein any value and range therebetween is explicitly contemplated and disclosed herein, such as optionally selected from the range of greater than or equal to approximately 10 to less than or equal to approximately 1000.

Aspect 74a: The system or method of any one of the preceding Aspects, wherein the outer barrier is characterized an H:M permeability ratio (defined elsewhere herein) being approximately 1. Aspect 74b: The system or method of any one of the preceding Aspects, wherein the outer barrier is characterized an H:Fe permeability ratio (defined elsewhere herein) being approximately 1.

Aspect 75: The system or method of any one of the preceding Aspects, wherein the midlyte solution is withdrawn at a rate of approximately 0.05 to approximately 15 liters per hour per square meter of cathode surface ($L/hr/m^2$), wherein any value and range therebetween is explicitly contemplated and disclosed herein, such as optionally approximately 0.1 $L/hr/m^2$ to approximately 10 $L/hr/m^2$, optionally approximately 0.05 $L/hr/m^2$ to approximately 5 $L/hr/m^2$.

Aspect 76: The system or method of any one of the preceding Aspects, wherein the catholyte region is characterized by a width selected from the range of approximately 5 mm to approximately 100 mm, wherein any value and range therebetween is explicitly contemplated and disclosed herein, such as approximately 10 mm to approximately 50 mm.

Aspect 77: The system or method of any one of the preceding Aspects, wherein the midlyte region is characterized by a width selected from the range of approximately 1 mm to approximately 50 mm, wherein any value and range therebetween is explicitly contemplated and disclosed herein, such as optionally approximately 1 mm to approximately 20 mm, optionally approximately 1 mm to approximately 10 mm, optionally approximately 5 mm to approximately 10 mm.

Aspect 78: The system or method of any one of the preceding Aspects, wherein the inner barrier or a pore-forming component of the inner barrier is formed of and/or consists essentially of one or more inorganic materials.

STATEMENTS REGARDING INCORPORATION BY REFERENCE AND VARIATIONS

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of any particular claimed invention. Thus, it should be understood that although inventions have been specifically disclosed by preferred embodiments, exemplary embodiments and optional features, modification and variation of the concepts herein disclosed may be resorted to by those skilled in the art, and that such modifications and variations are considered to be within the scope of inventions as defined by the appended claims. The specific embodiments provided herein are examples of useful embodiments of the inventions and it will be apparent to one skilled in the art that the inventions may be carried out using a large number of variations of the devices, device components, methods steps set forth in the present description. As will be obvious to one of skill in the art, methods and devices useful for the present methods can include a large number of optional composition and processing elements and steps.

As used herein and in the appended claims, the singular forms "a", "an", and "the" include plural reference unless the context clearly dictates otherwise. Thus, for example, reference to "a cell" includes a plurality of such cells and equivalents thereof known to those skilled in the art. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

When a group of substituents is disclosed herein, it is understood that all individual members of that group and all subgroups, including iron oxide materials of an ore or structural and compositional polymorphs of the group members, are disclosed separately. When a Markush group or other grouping is used herein, all individual members of the group and all combinations and sub-combinations possible of the group are intended to be individually included in the disclosure. When a compound is described herein such that a particular isomer, enantiomer or diastereomer of the compound is not specified, for example, in a formula or in a chemical name, that description is intended to include each isomers and enantiomer of the compound described individual or in any combination. Additionally, unless otherwise specified, all isotopic variants of compounds disclosed herein are intended to be encompassed by the disclosure. For example, it will be understood that any one or more hydrogens in a molecule disclosed can be replaced with deuterium or tritium. Isotopic variants of a molecule are generally useful as standards in assays for the molecule and in chemical and biological research related to the molecule or its use. Methods for making such isotopic variants are known in the art. Specific names of compounds are intended to be exemplary, as it is known that one of ordinary skill in the art can name the same compounds differently.

With regard to salts of the compounds herein, one of ordinary skill in the art can select from among a wide variety of available counterions those that are appropriate for preparation of salts of this invention for a given application. In specific applications, the selection of a given anion or cation for preparation of a salt may result in increased or decreased solubility of that salt.

Every device, system, subsystem, method, process, component, and/or combination of components, described or exemplified herein can be used to practice any claimed invention(s), unless otherwise stated.

Whenever a range is given in the specification, for example, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the disclosed devices, systems, methods, and processes pertain. References cited herein are incorporated by reference herein in their entirety to indicate the state of the art as of their publication or filing date and it is intended that this information can be employed herein, if needed, to exclude specific embodiments that are in the prior art. For example, when composition of matter are claimed, it should be understood that compounds known and available in the art prior to Applicant's inventions, including compounds for which an enabling disclosure is provided in the references cited herein, are not intended to be included in the composition of matter claims herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The claimed inventions illustratively described herein suitably may be practiced in the absence of any element or elements, limitation or limitations which is not specifically disclosed herein.

One of ordinary skill in the art will appreciate that starting materials, reagents, synthetic methods, purification methods, analytical methods, and assay methods other than those specifically exemplified can be employed in the practice of the claimed inventions without resort to undue experimentation. All art-known functional equivalents, of any such materials and methods are intended to be included in these inventions.

The term "and/or" is used herein, in the description and in the claims, to refer to a single element alone or any combination of elements from the list in which the term and/or appears. In other words, a listing of two or more elements having the term "and/or" is intended to cover embodiments having any of the individual elements alone or having any combination of the listed elements. For example, the phrase "element A and/or element B" is intended to cover embodiments having element A alone, having element B alone, or having both elements A and B taken together. For example, the phrase "element A, element B, and/or element C" is intended to cover embodiments having element A alone, having element B alone, having element C alone, having elements A and B taken together, having elements A and C taken together, having elements B and C taken together, or having elements A, B, and C taken together.

We claim:

1. An iron electrowinning system comprising:
an iron electrowinning cell comprising:
a plating bath containing an aqueous catholyte having dissolved iron ions therein;
a plurality of cathodes in contact with the catholyte and configured to electrodeposit iron metal thereon via electrochemical reduction of the dissolved iron ions; and
a plurality of removable anode cartridge assemblies, each comprising:
an anode configured to produce oxygen gas thereon via electrochemical water oxidation;
an inner barrier defining an anolyte-region between the inner barrier and the anode, the anolyte-region containing an anolyte in contact with the anode; and
an outer barrier defining a midlyte-region between the outer barrier and the inner barrier, the midlyte-region containing a midlyte, the midlyte being separated from the anolyte by the inner barrier and separated from the catholyte by the outer barrier;
wherein the anode, inner barrier, and outer barrier are all suspended from a common hanger bar,
wherein the inner barrier is in the form of a bag surrounding the anode and the outer barrier is in the form of a bag surrounding the inner barrier;
wherein a liquid level of the catholyte is higher than a liquid level of the midlyte, thereby establishing a pressure difference between the catholyte and the midlyte across the outer barrier sufficient to cause catholyte to flow through the outer barrier into the midlyte-region;
wherein a total dissolved ion concentration in the anolyte is greater than a total dissolved ion concentration in the midlyte such that water is supplied from the midlyte to the anolyte-region via osmosis through the inner barrier;
wherein each anode cartridge assembly is configured such that a portion of the midlyte is withdrawn during operation of the cell;
wherein a net flow of water from the catholyte to the anolyte is established by the pressure difference between the catholyte and the midlyte in combination with the anolyte having a greater total ion concentration than the midlyte;
wherein each of the inner barrier and the outer barrier is porous; and
wherein the inner barrier is characterized by an O90 pore size being less than that of the outer barrier.

2. The system of claim 1, wherein the cell further comprises a withdrawal structure for withdrawing the midlyte from the midlyte-region.

3. The system of claim 2, wherein the withdrawal structure is a tube or spillover structure.

4. The system of claim 3, wherein a position or depth of the tube or spillover structure in the midlyte-region determines a liquid level of the midlyte.

5. The system of claim 1, wherein the inner barrier is characterized by a higher H:Fe permeability ratio than the outer barrier.

6. The system of claim 1, wherein the midlyte-region is characterized by a width selected from the range of approximately 1 mm to approximately 50 mm.

7. The system of claim 1, further comprising a first spacer between the outer barrier and the inner barrier and establishing a width of the midlyte-region.

8. The system of claim 1, wherein neither the inner barrier nor the outer barrier comprises an ion-exchange polymer.

9. The system of claim 1, wherein the inner barrier is characterized by a ratio of permeability of aqueous protons to permeability of aqueous iron cations being at least 5.

10. The system of claim 1, wherein a flux of aqueous iron ions across the outer barrier is greater than a flux of aqueous iron ions across the inner barrier.

11. The system of claim 1, wherein a flux of protons across the inner barrier is at least 10 times greater than a flux of iron ions across the inner barrier.

12. The system of claim 11, wherein the inner barrier is formed of a nanoporous material, a microporous material, or a combination of nanoporous and microporous materials.

13. The system of claim 11, wherein the inner barrier comprises a nonwoven material.

14. The system of claim 11, wherein the outer barrier is a diaphragm.

15. The system of claim 1, wherein the inner barrier is characterized by an O90 pore size selected from the range of 1 Å to 1 μm.

16. The system of claim 1, wherein the inner barrier is characterized by an electrical resistance selected from the range of 0.1 to 50 $m\Omega cm^2$.

17. The system of claim 1, wherein the inner barrier surrounds all electrolyte-exposed portions of the anode's surface.

18. The system of claim 17, wherein the inner barrier surrounds all sides except the top surface of the anode.

19. The system of claim 1, wherein the outer barrier surrounds all electrolyte-exposed portions of the inner barrier's outer surface.

20. The system of claim 1, wherein each anode cartridge assembly is removable and insertable monolithically into the plating bath by moving the hanger bar.

21. The system of claim 1, wherein the midlyte has a pH selected from the range of range of −0.5 to 3.

22. The system of claim 21, wherein the midlyte has a ferric ion concentration selected from the range of 0.001 M to 0.5 M.

23. The system of claim 1, wherein the anolyte has a total iron ion concentration selected from the range of 0.001 M to 1.5 M.

24. The system of claim 1, further comprising a leaching subsystem configured to leach an iron feedstock material and produce a first ferrous-rich aqueous acidic solution; wherein the system is configured to withdraw midlyte from the midlyte-region and provide the withdrawn midlyte to the leaching subsystem.

25. The system of claim 24, wherein a leach solution removed from the leaching subsystem is delivered to the plating bath.

26. The system of claim 1, wherein the inner barrier is characterized by a bulk liquid permeability less than that of the outer barrier.

27. An iron electrowinning system comprising:
an iron electrowinning cell comprising:
a plating bath containing a catholyte having dissolved iron ions therein;
a cathode in contact with the catholyte and configured to electrodeposit iron metal thereon via electrochemical reduction of the dissolved iron ions; and
a removable anode cartridge assembly comprising:

an anode configured to produce oxygen gas thereon via electrochemical water oxidation;

an inner barrier defining an anolyte-region between the inner barrier and the anode, the anolyte-region containing an anolyte in contact with the anode; and an outer barrier defining a midlyte-region between the outer barrier and the inner barrier, the midlyte-region containing a midlyte, the midlyte being separated from the anolyte by the inner barrier and separated from the catholyte by the outer barrier;

wherein the anode, inner barrier, and outer barrier are all suspended from a common hanger bar;

wherein each of the inner barrier and the outer barrier is porous;

wherein the inner barrier is formed of a nanoporous membrane, a microporous membrane, or a combination of nanoporous and microporous membranes; and wherein the inner barrier is characterized by an O90 pore size being less than that of the outer barrier.

28. A method of making electrolytic iron in an iron electrowinning system comprising:

in an iron electrowinning cell comprising:

a plating bath containing a catholyte having dissolved iron ions therein; and a cathode in contact with the catholyte and configured to electrodeposit iron metal thereon via electrochemical reduction of the dissolved iron ions;

a removable anode cartridge assembly comprising:

an anode configured to produce oxygen gas thereon via electrochemical water oxidation;

an inner barrier defining an anolyte-region between the inner barrier and the anode, the anolyte-region containing an anolyte in contact with the anode; and an outer barrier defining a midlyte-region between the outer barrier and the inner barrier, the midlyte-region containing a midlyte, the midlyte being separated from the anolyte by the inner barrier and separated from the catholyte by the outer barrier;

wherein the anode, inner barrier, and outer barrier are all suspended from a common hanger bar;

the method comprising:

maintaining a pressure difference between the catholyte and the midlyte across the outer barrier sufficient to cause catholyte to flow through the outer barrier into the midlyte-region;

withdrawing a portion of midlyte from the midlyte-region;

providing water from the midlyte-region to the anolyte-region through the inner barrier at a rate sufficient to replace water consumed in the anolyte via the electrochemical water oxidation:

electrodepositing iron metal on the cathode; and electrochemically oxidizing water and evolving oxygen at the anode.

29. The method of claim 28, further comprising providing the withdrawn midlyte to a leaching subsystem, leaching an iron feedstock material in the leaching subsystem to produce an iron-rich leach solution, and delivering the iron-rich leach solution to the plating bath.

30. The method of claim 28 comprising maintaining a greater total dissolved ion concentration in the anolyte than a total dissolved ion concentration in the midlyte thereby osmotically supplying water from the midlyte to the anolyte-region through the inner barrier.

* * * * *